US007854405B2

(12) United States Patent
Adachi et al.

(10) Patent No.: US 7,854,405 B2
(45) Date of Patent: Dec. 21, 2010

(54) DOCUMENT DISPOSAL APPARATUS

(75) Inventors: Shintaro Adachi, Kanagawa (JP); Tsutomu Kimura, Kanagawa (JP); Noriko Arai, Kanagawa (JP); Kenji Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 12/176,485

(22) Filed: Jul. 21, 2008

(65) Prior Publication Data

US 2009/0078806 A1 Mar. 26, 2009

(30) Foreign Application Priority Data

Sep. 26, 2007 (JP) ..... 2007-249929

(51) Int. Cl.
*B02C 19/00* (2006.01)

(52) U.S. Cl. ..... 241/34; 241/222; 241/236

(58) Field of Classification Search ..... 241/33–34, 241/36, 220, 222, 236
See application file for complete search history.

(56) References Cited

U.S. PATENT DOCUMENTS 5,188,301 A * 2/1993 Hasegawa ..... 241/33
2003/0146275 A1* 8/2003 Bennett et al. ..... 235/376
2007/0057099 A1 3/2007 Kubo et al.

FOREIGN PATENT DOCUMENTS

JP 2007-135174 A 5/2007

* cited by examiner

*Primary Examiner*—Faye Francis
(74) *Attorney, Agent, or Firm*—Sughrue Mion, PLLC

(57) ABSTRACT

There is provided a document destruction apparatus including: a destruction section that destroys documents; a conveyance section that conveys documents to the destruction section a page at a time; a reading section that is disposed partway along the conveyance section and that, from a document to which identification information for identifying the document has been applied to each page at at least one of a conveyance direction leading end side and trailing end side, reads the identification information at each page; and an alteration section that, in a case in which the identification information has been read at the conveyance direction leading end side by the reading section, alters a conveyance direction of the page that has been read such that the page will be conveyed from the conveyance direction trailing end side.

8 Claims, 19 Drawing Sheets

DOCUMENT DISPOSAL APPARATUS

CROSS-REFERENCE TO RELATED APPLICATION

This application is based on and claims priority under 35 USC 119 from Japanese Patent Application No. 2007-249929 filed on Sep. 26, 2007.

BACKGROUND

1. Technical Field

The present invention relates to a document disposal apparatus.

2. Related Art

In recent years, technologies for performing document management of confidential documents and the like have been investigated.

However, in a conventional system, if destruction processing is emergency-stopped during destruction of one sheet of a document, that is, before the one sheet of the document has been completely destroyed, and a region at which the document ID was applied has already been destroyed, management as to whether or not the document should be completely destroyed may not be possible.

SUMMARY

According to an aspect of the invention, there is provided a document destruction apparatus including:

a destruction section that destroys documents;

a conveyance section that conveys documents to the destruction section a page at a time;

a reading section that is disposed partway along the conveyance section and that, from a document to which identification information for identifying the document has been applied to each page at at least one of a conveyance direction leading end side and trailing end side, reads the identification information at each page; and an alteration section that, in a case in which the identification information has been read at the conveyance direction leading end side by the reading section, alters a conveyance direction of the page that has been read such that the page will be conveyed from the conveyance direction trailing end side.

BRIEF DESCRIPTION OF THE DRAWINGS

Exemplary embodiments of the present invention will be described in detail based on the following figures, wherein.

DETAILED DESCRIPTION

Herebelow, exemplary embodiments of the present invention will be described in detail with reference to the drawings.

Figure 1:
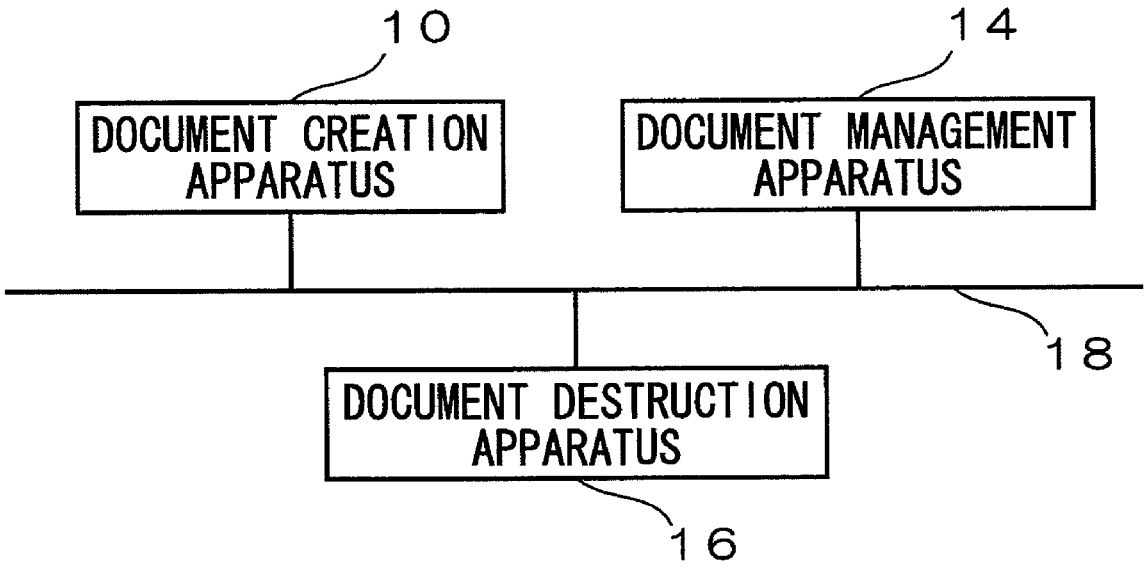
FIG. 1 is a conceptual diagram showing an overall representation of present exemplary embodiments.

FIG. 1 is a diagram showing structure of a document management system relating to exemplary embodiments of the present invention. The document management system is structured to include a document creation apparatus 10, a document management apparatus 14 and a document destruction apparatus 16. The document creation apparatus 10, the document management apparatus 14 and the document destruction apparatus 16 are respectively connected to one another by a shared network 18.

Figure 2:
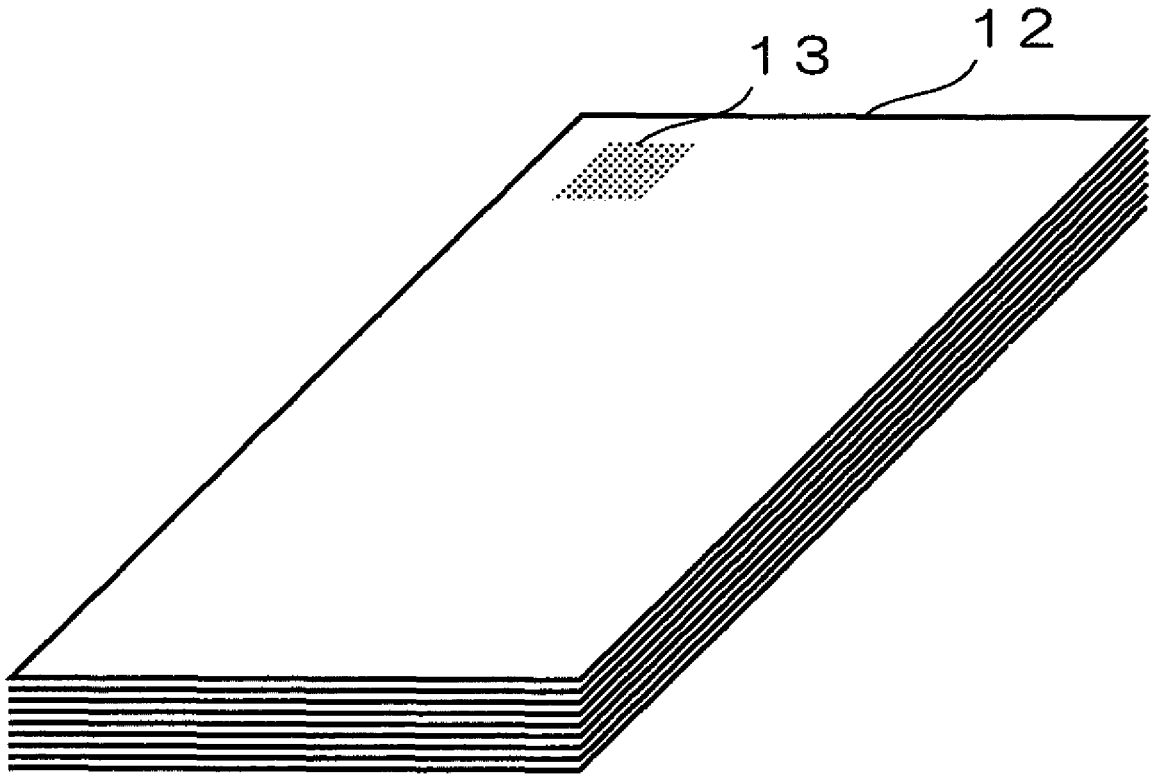
FIG. 2 is a schematic view of a document relating to the present exemplary embodiments.

As shown in FIG. 2, the document creation apparatus 10 creates a document 12 to which a QR code (registered trademark) 13 is applied at a position that will be at a conveyance direction leading end side or a conveyance direction trailing end side during conveyance. The QR code 13 is a type of two-dimensional code containing a document ID for identifying the document, which is widely used.

A document management table is memorized at the document management apparatus 14, in which at least destruction information including a document creation date/time, a document retention period and a document destruction date/time is registered in association with the document ID included in the QR code 13 that has been applied to the document 12. The document creation date/time is represented with a date and time at which the document was created, and the document retention period represents a retention period of the document with a date and time. The document retention period of a document that can be destroyed at any time may be registered with information indicating "unspecified", and the document retention period of a document that can never be destroyed may be registered with information indicating "permanent". The document destruction date/time is represented with a date and time at which the document has been destroyed. In response to an enquiry for destruction permission for a document identified by a document ID, the document management apparatus 14 checks the retention period of the document that corresponds to the identified document ID, and gives a destruction permission if the retention period has been exceeded. Thus, the document management apparatus 14 manages documents created by the document creation apparatus 10 until the documents are destroyed.

The document destruction apparatus 16 implements destruction processing of a document that was created by the document creation apparatus 10 and has become a destruction subject. Accordingly, the document destruction apparatus 16 identifies the document ID of a document for which destruction of the document has been implemented to the document management apparatus 14, and the document destruction date/time in the document management table is represented with a date and time at which the document destruction apparatus 16 has notified the document management apparatus 14 that destruction of the document has been completed.

Herebelow, the document destruction apparatus 16 will be described in detail.

First Exemplary Embodiment

Figure 3:
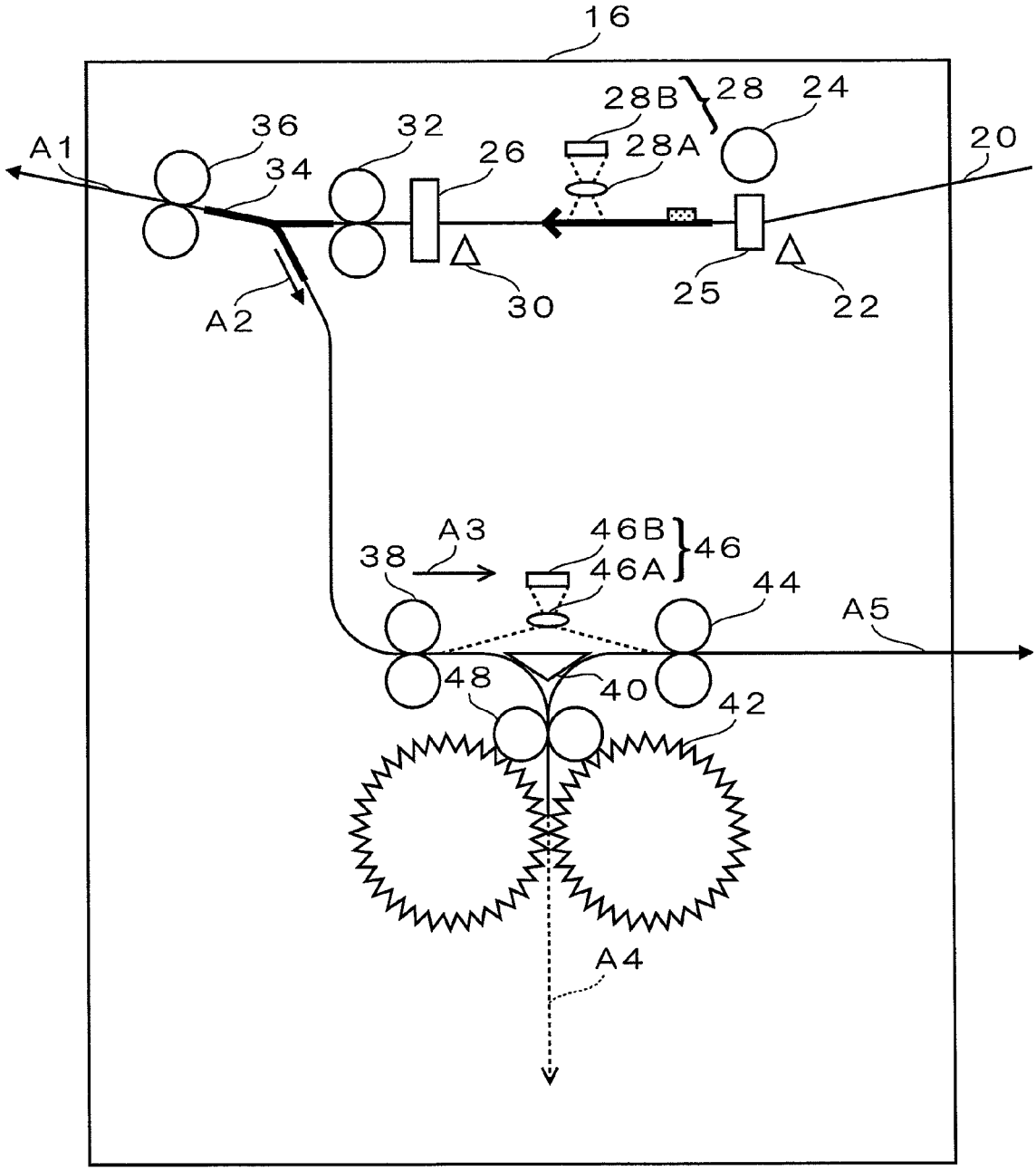
FIG. 3 is a structural view of principal elements of a document destruction apparatus relating to a first exemplary embodiment.

Structure of principal elements of the document destruction apparatus 16 will be described with reference to FIG. 3.

The document destruction apparatus 16 is provided with a document tray unit 20 at which documents which are to be destruction subjects are placed. The document tray unit 20 is formed in a state which is inclined at an angle from the horizontal, so as to progressively descend toward a placing sensor 22, which detects that documents have been placed in the document tray unit 20.

The placing sensor 22 is structured with, for example, a reflection-type optical sensor including a light-emitting element and a light-detecting element. When a document is present at a sensing position of the placing sensor 22, light reflected from the document is detected and the placing sensor 22 is in an on state, and when no document is present, the placing sensor 22 is in an offstate.

A drawing roller 24 and a separation member 25 are provided in a vicinity of the placing sensor 22. The drawing roller 24 conveys documents which have been placed in the document tray unit 20 by drawing in and automatically feeding the documents, sequentially, from a page placed at a topmost position of the document tray unit 20, toward a stopper gate 26. The separation member 25 separates the documents from one another such that drawing of the documents by the drawing roller 24 can be sequentially performed one sheet at a time.

A scanner 28 is provided at a document conveyance direction leading end side of the drawing roller 24 and the separation member 25. Via a lens 28B, the scanner 28 detects light emitted from a light source (not shown) with a line sensor 28A, at which pixels are arranged in a direction intersecting the document conveyance direction. Thus, the scanner 28 reads the whole surface of a document that is drawn in by the drawing roller 24 and conveyed toward the stopper gate 26, and scans a QR code which has been applied to the document.

An insertion sensor 30 is provided in a vicinity of the stopper gate 26. The insertion sensor 30 detects when a document reaches the stopper gate 26. The insertion sensor 30 is structured with, for example, a reflection-type optical sensor including a light-emitting element and a light-detecting element. When a document is present at a sensing position of the insertion sensor 30, the insertion sensor 30 is in an on state, and when no document is present, the insertion sensor 30 is in an off state.

The stopper gate 26 is structured with, for example, a long strip-form plate member, and is provided between the drawing roller 24 and a first feed roller 32.

The stopper gate 26 is set to a state which closes off a document conveyance path in a condition in which the stopper gate 26 protrudes into the document conveyance path, and blocks the document conveyance path. Accordingly, when the stopper gate 26 is closed, a leading end portion of the document that has been drawn in by the drawing roller 24 abuts against the stopper gate 26. Therefore, even in a case in which an operator has placed documents in a disorganized manner, conveyance of a document to a shredder unit 42 can be blocked by abutting against the stopper gate 26.

Alternatively, the stopper gate 26 is set to a state which opens the document conveyance path in a condition in which the stopper gate 26 has been retracted from the conveyance path so as to be withdrawn from the document conveyance path, and the document conveyance path is opened up. Accordingly, the leading end portion of a document that has been drawn in by the drawing roller 24 abuts against a nipping portion of the first feed roller 32.

The first feed roller 32 turns while nipping, at the nipping portion, a document which has been conveyed thereto along the document conveyance path that has been opened up by the stopper gate 26, and thus conveys the document along the document conveyance path.

At a branching position of the document conveyance path, which splits into a bifurcated state at the document conveyance direction leading end side of the first feed roller 32, a first branching gate 34 switches the document conveyance path so as to guide a document which has been conveyed by turning of the first feed roller 32 in the direction of a second feed roller 36, and also switches the document conveyance path so as to convey a document which has been conveyed by turning of the second feed roller 36 to a third feed roller 38.

The second feed roller 36 turns while nipping, at a nipping portion, a document which has been conveyed thereto by the first feed roller 32, and thus conveys the document along the document conveyance path in the direction of arrow A1. Then, the turning direction is reversed, and thus the document is conveyed along the document conveyance path in the direction of arrow A2.

The third feed roller 38 turns while nipping, at a nipping portion, a document which has been conveyed thereto by the second feed roller 36, and thus conveys the document along the document conveyance path in the direction of arrow A3.

At a branching position of the document conveyance path, which splits into a bifurcated state at the document conveyance direction leading end side of the third feed roller 38, a second branching gate 40 switches a direction of progress of the document conveyance path. That is, the second branching gate 40 switches the direction of progress of the document which has been conveyed by turning of the third feed roller 38 to either of a direction toward the shredder unit 42 and a direction toward a fourth feed roller 44. Further, by reversing a turning direction of the fourth feed roller 44, the direction of progress of a document that is being conveyed by turning thereof is switched to a direction toward the shredder unit 42.

The shredder unit 42 destroys the document that has been drawn in by the third feed roller 38 or the fourth feed roller 44, by shredding the document while drawing it in a fifth feed roller 48 draws in the document in the direction of arrow A4.

The fourth feed roller 44 turns while nipping, at a nipping portion, a document which has been conveyed thereto by the third feed roller 38, and thus conveys the document along the document conveyance path in the direction of arrow A5. Further, by reversing the turning direction, the document is conveyed along the document conveyance path in the direction of the shredder unit 42.

A path scanner 46 scans a document in the document conveyance path just before the document reaches the shredder unit 42 from the second feed roller 36 or the fourth feed roller 44. Via a lens 46B, the path scanner 46 detects light reflected from a light source (not shown) with an area sensor 46A, and thus scans the document. When a document is present at a scanning position of the path scanner 46, the path scanner 46 is in an on state, and when no document is present, the path scanner 46 is in an off state. Accordingly, when a leading end portion of a document passes through the scanning position of the path scanner 46, the path scanner 46 simultaneously switches from the off state to the on state, and thereafter, when a trailing end portion of the document passes through the scanning position of the path scanner 46, the path scanner 46 simultaneously switches from the on state to the off state. When destruction processing by the shredder unit 42 has been emergency-stopped, the path scanner 46 scans the whole surface of a document and reads a QR code from the document.

Figure 4:
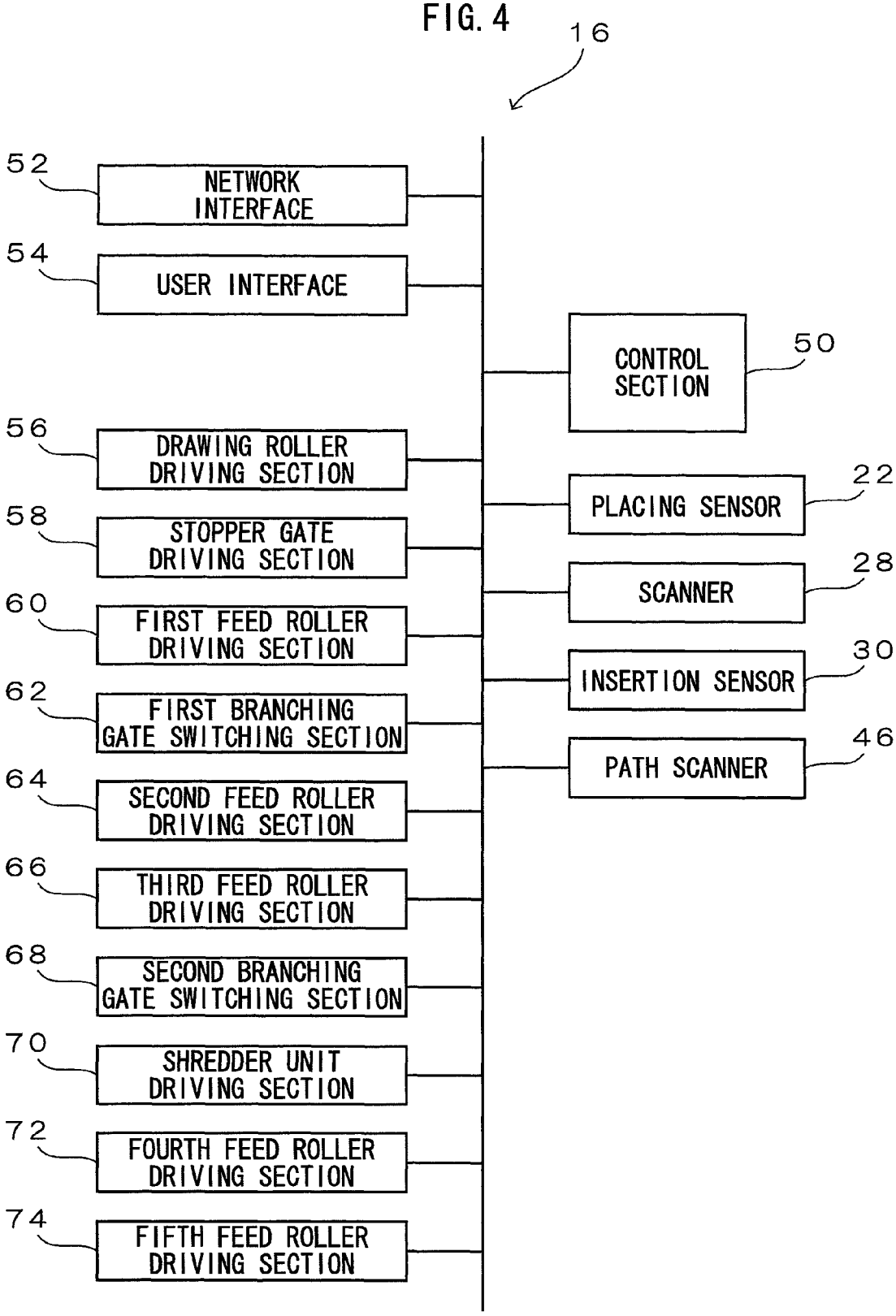
FIG. 4 is a structural diagram of a control system of the document destruction apparatus relating to the first exemplary embodiment.

The document destruction apparatus 16 is also structured to include a microcomputer as shown in FIG. 4, and is provided with a control section 50 that controls various processing operations relating to document destruction in accordance with a program. The document destruction apparatus 16 is further structured to include a network interface 52, for implementing exchanges of data with other devices through the network 18 (including the document creation apparatus 10 and the document management apparatus 14), and a user interface 54, which is structured utilizing operation buttons (for example, a start button, a stop button and the like) and a display panel, which displays various messages, including states of operation of the document destruction apparatus 16 and guidance for operations (guidance messages and the like).

The document destruction apparatus 16 is further structured to include: a drawing roller driving section 56, which is structured with, for example, a magnetic plunger as a drive source for roller-raising/lowering operations and a motor as a drive source for roller turning operations, and which causes raising/lowering operations and turning operations of the aforementioned drawing roller 24; a stopper gate driving section 58, which is structured with, for example, a magnetic plunger as a drive source and which causes opening/closing operations of the aforementioned stopper gate 26; a first feed roller driving section 60, which is structured with, for example, a motor as a drive source and which causes turning operations of the aforementioned first feed roller 32; a first branching gate switching section 62, which is structured with, for example, a magnetic plunger as a drive source and which switches the aforementioned first branching gate 34; a second feed roller driving section 64, which is structured with, for example, a motor as a drive source and which causes turning operations of the aforementioned second feed roller 36; a third feed roller driving section 66, which is structured with, for example, a motor as a drive source and which causes turning operations of the aforementioned third feed roller 38; a second branching gate switching section 68, which is structured with, for example, a magnetic plunger as a drive source and which switches the aforementioned second branching gate 40; a shredder unit driving section 70 that drives turning of the aforementioned shredder unit 42; a fourth feed roller driving section 72, which is structured with, for example, a motor as a drive source and which causes turning operations of the aforementioned fourth feed roller 44; and a fifth feed roller driving section 74, which is structured with, for example, a motor as a drive source and which causes turning operations of the fifth feed roller 48.

The placing sensor 22, the scanner 28, the insertion sensor 30, the path scanner 46, the network interface 52, the user interface 54, the drawing roller driving section 56, the stopper gate driving section 58, the first feed roller driving section 60, the first branching gate switching section 62, the second feed roller driving section 64, the third feed roller driving section 66, the second branching gate switching section 68, the shredder unit driving section 70, the fourth feed roller driving section 72 and the fifth feed roller driving section 74 are respectively electrically connected to the control section 50. The control section 50 controls the whole of the document destruction apparatus 16 in accordance with a control program provided in advance.

Figure 5A:
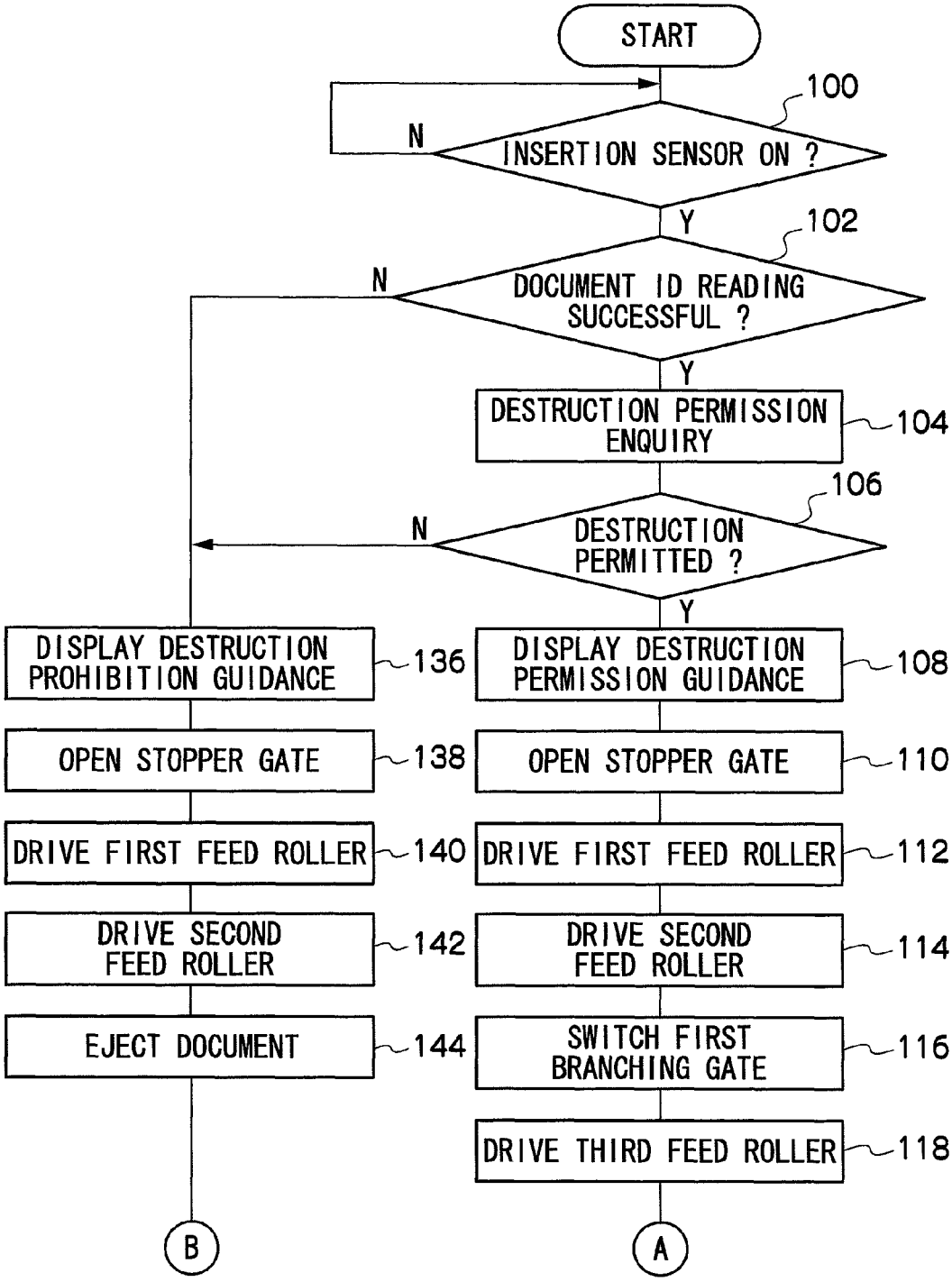
FIG. 5A is a flowchart showing a destruction processing routine when an emergency stop does not occur, relating to the first exemplary embodiment.
Figure 5B:
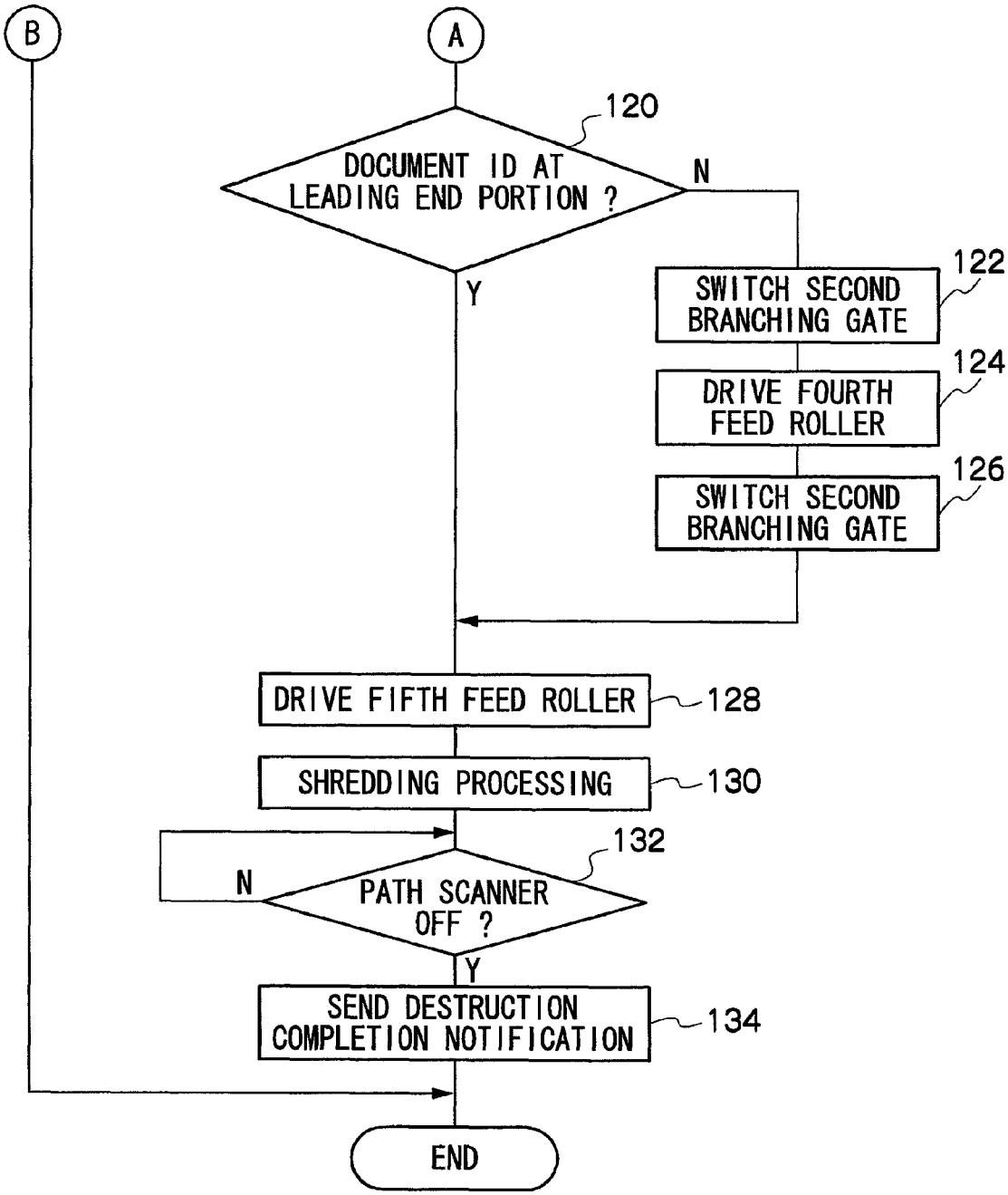
FIG. 5B is a flowchart showing a destruction processing routine when an emergency stop does not occur, relating to the first exemplary embodiment.
Figure 7:
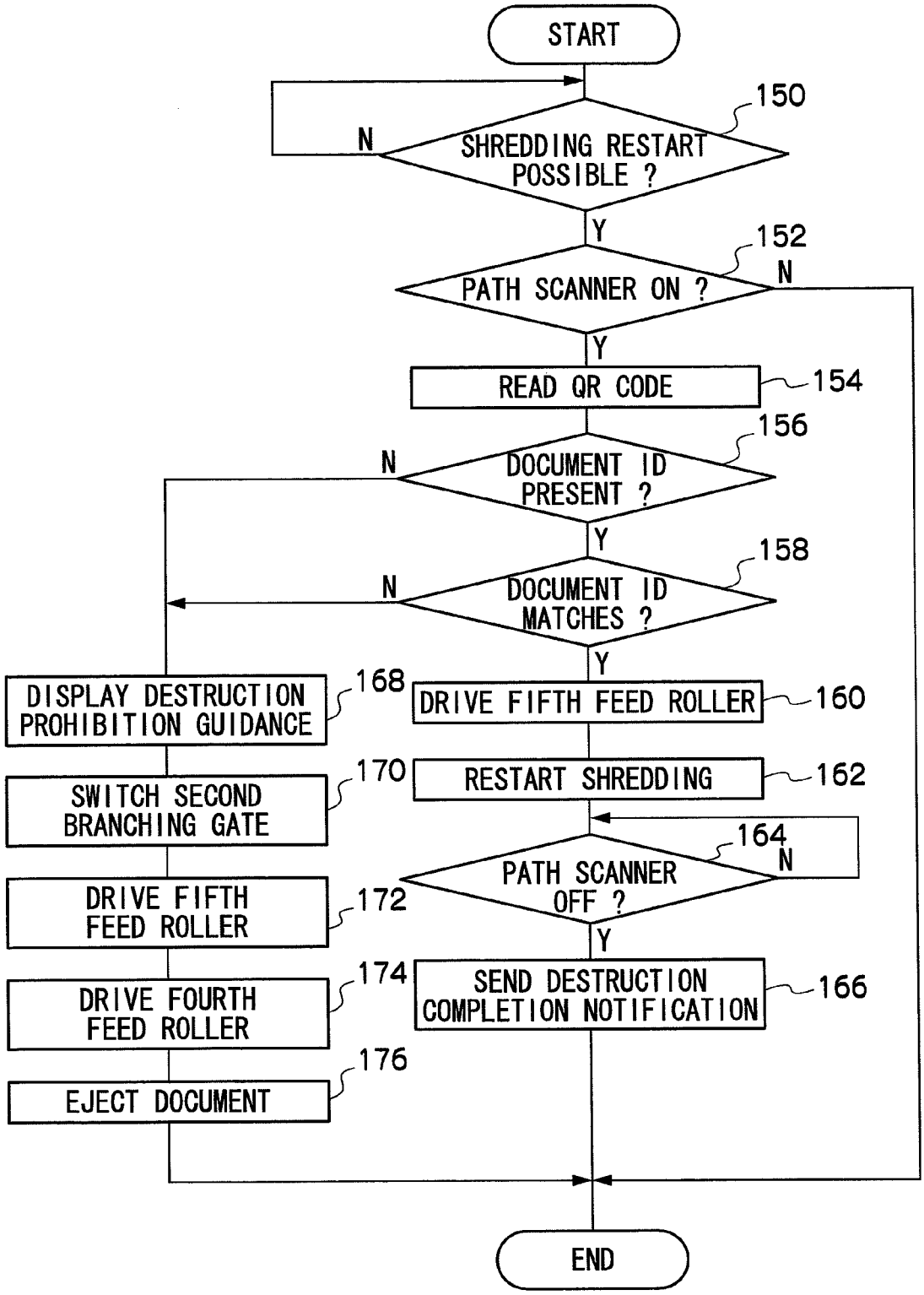
FIG. 7 is a flowchart showing a destruction processing routine when an emergency stop has occurred, relating to the first exemplary embodiment.

Next, description will be given of a destruction processing routine according to the control section 50, with reference to FIGS. 5A, 5B and FIG. 7. A program of this processing routine is memorized at a memory serving as a memory medium which is included at the control section 50.

First, referring to FIGS. 5A, 5B, the destruction processing routine according to the control section 50 will be described for a case in which an emergency stop does not occur.

In step 100, it is determined whether or not the insertion sensor 30 is in the on state. If the determination is positive, the routine proceeds to step 102, and if negative, the routine returns to step 100.

In step 102, it is determined whether or not the scanner 28 has succeeded in reading of a QR code that has been applied to a document. Whether or not reading of a QR code has succeeded is judged by whether or not a document ID can be extracted from the QR code printed on the document. Cases that can be mentioned in which the scanner 28 fails in reading of a QR code are: a case in which no QR code has been applied to the document; a case in which the QR code is not present because a facing when the document was inserted (a face-up/face-down orientation of the document) was inappropriate; a case in which the QR code is present but severe soiling or damage has occurred at the QR code or the QR code does not include a document ID; and so forth. If the judgment of step 102 is positive, the routine proceeds to step 104, and if negative, the routine proceeds to step 136.

In step 104, an enquiry to the document management apparatus 14, as to whether or not destruction is permitted for the document specified by the document ID included in the QR code, is implemented. The document destruction permission enquiry is implemented by creating a destruction permission enquiry message, which identifies the document ID included in the QR code that was read by the scanner 28, and sending this enquiry message from the network interface 52 to the document management apparatus 14 via the network 18.

The document management apparatus 14, having received the enquiry message, searches for whether the document ID identified in the enquiry message has been registered in the document management table. If the corresponding document ID is present, the document management apparatus 14 checks the document retention period registered in association with the document ID. Then, if the time/date at which the document destruction permission enquiry was received from the document destruction apparatus 16 has exceeded the document retention period, the document management apparatus 14 returns a response message to the document destruction apparatus 16 indicating that a document destruction permission is being given, but if the time/date at which the document destruction permission enquiry was received from the document destruction apparatus 16 has not exceeded the document retention period, the document management apparatus 14 returns a response message to the document destruction apparatus 16 indicating that a document destruction permission is not being given.

In step 106, it is determined whether a response message indicating that a document destruction permission is being given has been received from the document management apparatus 14 or a response message indicating that a document destruction permission is not being given has been received. If a response message indicating that a document destruction permission is being given has been received, the routine proceeds to step 108, and if a response message indicating that a document destruction permission is not being given has been received, the routine proceeds to step 136.

In step 108, destruction permission guidance, which has been prepared in advance, is displayed at the user interface 54.

In step 110, the stopper gate driving section 58 is controlled and the stopper gate 26 opens. When the trailing end portion of the document passes through the sensing position of the insertion sensor 30 and accordingly the insertion sensor 30 switches from the on state to the off state, the stopper gate driving section 58 is controlled and the stopper gate 26 returns to the closed state with a predetermined timing which has been specified in advance (for example, a timing for the trailing end portion of the document to disengage from the first feed roller 32).

In step 112, the first feed roller driving section 60 is controlled and the first feed roller 32 is turned. In step 114, the second feed roller driving section 64 is controlled and the second feed roller 36 is turned. In addition, by control of the second feed roller driving section 64 and reversal of the turning direction of the second feed roller 36, the document is conveyed in the direction of the first branching gate 34.

In step 116, the first branching gate switching section 62 is controlled and the first branching gate 34 is switched such that the document is conveyed in the direction of arrow A2.

In step 118, the third feed roller driving section 66 is controlled and the third feed roller 38 is turned, and the document is conveyed in the direction of arrow A3.

In step 120, it is judged whether or not the QR code that has been read by the scanner 28 had been applied at the conveyance direction leading end side of the document. If the determination is positive, the routine proceeds to step 128, and if negative, the routine proceeds to step 122.

In step 122, the second branching gate switching section 68 is controlled and the second branching gate 40 is switched such that the document is conveyed in the direction of the fourth feed roller 44.

In step 124, the fourth feed roller driving section 72 is controlled and the fourth feed roller 44 is turned. Thus, the document is conveyed in the direction of arrow A5. In addition, by control of the fourth feed roller driving section 72 and reversal of the turning direction of the fourth feed roller 44, the document is conveyed in the direction of the second branching gate 40.

In step 126, the second branching gate switching section 68 is controlled and the second branching gate 40 is switched such that the document is conveyed in the direction of the shredder unit 42.

In step 128, the fifth feed roller driving section 74 is controlled and the fifth feed roller 48 is turned, and conveys the document to the shredder unit 42. By the processing of step 122 to step 126, the document is conveyed into the shredder unit 42, starting from an end thereof at which the document ID was not applied.

In step 130, the shredder unit driving section 70 is controlled and the shredder unit 42 is driven, and the document that has been fed in by the fifth feed roller 48 is taken in, shredded and destroyed. Driving of the shredder unit 42 by the shredder unit driving section 70 is started by the document being at the scanning position of the path scanner 46 and the path scanner 46 switching from the off state to the on state.

In step 132, it is determined whether or not the document is absent from the scanning position of the path scanner 46 and the path scanner 46 has switched from the on state to the off state. If the determination is positive, the routine proceeds to step 134, and if negative, the routine returns to step 132.

In step 134, the shredder unit driving section 70 is controlled and, after a predetermined duration (for example, after a duration required until the trailing end portion of the document is taken into the shredder unit 42 and the whole document is shredded), driving of the shredder unit 42 stops, and a destruction completion notification, identifying the document ID of the document and indicating that destruction of the document has been completed, is sent to the document management apparatus 14 as a message.

Accordingly, the document management apparatus 14 registers a date/time at which the message was received in a document destruction date/time field, which serves as destruction history information corresponding to the document ID identified in the message.

Alternatively, if the determination of step 102 or of step 106 was negative, in step 136, destruction prohibition guidance, which has been prepared in advance, is displayed at the user interface 54.

In step 138, the stopper gate driving section 58 is controlled and the stopper gate 26 is opened. In step 140, the first feed roller driving section 60 is controlled and the first feed roller 32 is turned, and in step 142, the second feed roller driving section 64 causes the second feed roller 36 to turn. Thus, the document is conveyed in the direction of arrow A1, and is ejected (step 144) to an ejection tray (not shown).

Figure 6A:
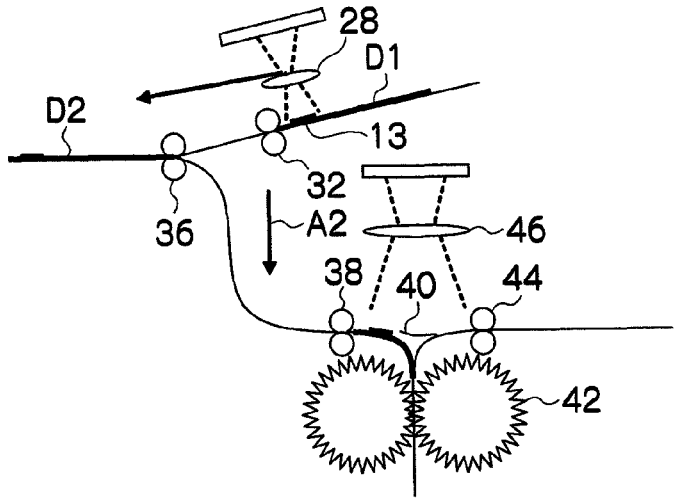
FIG. 6A is a diagram showing schematics of document conveyance in the document destruction apparatus relating to the first exemplary embodiment.

FIG. 6A shows operations when a document is placed such that the position of application of the QR code is at the conveyance direction leading end side. When a document D1 is placed such that the position of application of the QR code 13 is at the conveyance direction leading end side and the QR code 13 has been read at the conveyance direction leading end side, the document D1 is conveyed in the direction of the second feed roller 36 by turning of the first feed roller 32, and is conveyed to a position of document D2 by turning of the second feed roller 36. The document D2 is conveyed in the direction of A2 by the turning direction of the second feed roller 36 being reversed. Thus, the position of application of the QR code is at the conveyance direction trailing end side of the document. By turning of the third feed roller 38, the document is shredded by the shredder unit 42 starting from the end at which the QR code is not applied.

Figure 6B:
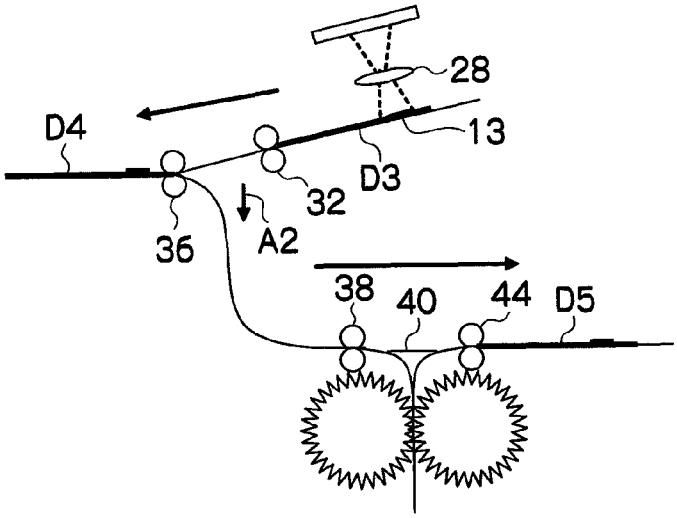
FIG. 6B is a diagram showing the schematics of document conveyance in the document destruction apparatus relating to the first exemplary embodiment.
Figure 6C:
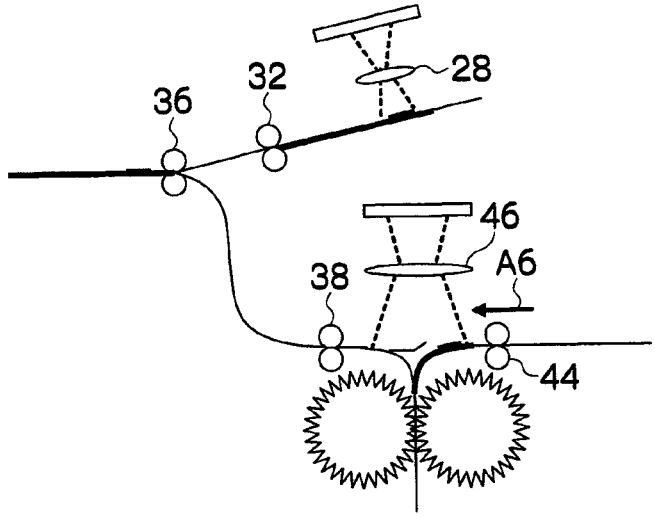
FIG. 6C is a diagram showing the schematics of document conveyance in the document destruction apparatus relating to the first exemplary embodiment.

FIG. 6B and FIG. 6C show operations when a document is placed such that the position of application of the QR code is at the conveyance direction trailing end side.

As shown in FIG. 6B, when a document D3 is placed such that the position of application of the QR code 13 is at the conveyance direction trailing end side and the QR code 13 has been read at the conveyance direction trailing end side, the document D3 is conveyed in the direction of the second feed roller 36 by turning of the first feed roller 32, and is conveyed to a position of document D4 by turning of the second feed roller 36. The document is conveyed in the direction of A2 by the turning direction of the second feed roller 36 being reversed. Thus, the position of application of the QR code is at the conveyance direction leading end side of the document. The second branching gate 40 is switched, the document is conveyed in the direction of the fourth feed roller 44 by turning of the third feed roller 38, and is conveyed to a position of document D5 by turning of the fourth feed roller 44.

As shown in FIG. 6C, the document is conveyed in the direction of A6 by the turning direction of the fourth feed roller 44 being reversed. Thus, the position of application of the QR code is at the conveyance direction trailing end side of the document. The second branching gate 40 is switched and, by the turning of the fourth feed roller 44, the document is shredded by the shredder unit 42 starting from the end at which the QR code is not applied.

Next, referring to FIG. 7, the destruction processing routine according to the control section 50 will be described for a case in which an emergency stop has occurred.

In step 150, it is determined whether or not a restart of shredding processing is possible. If the determination is positive, the routine proceeds to step 152, and if negative, the routine returns to step 150.

In step 152, it is determined whether or not the path scanner 46 is in the on state. If the determination is positive, the routine proceeds to step 154, and if negative, the present routine ends.

In step 154, movement of the path scanner 46 in the direction of arrow A4 is commenced.

In step 156, it is determined whether or not the path scanner 46 has succeeded in reading the QR code applied to the document. Whether or not reading of the QR code has succeeded is judged by whether or not a document ID could be extracted from the QR code applied to the document. If the determination is positive, the routine proceeds to step 158, and if negative, the routine proceeds to step 168.

In step 158, it is determined whether or not the document ID that has been extracted by the path scanner 46 matches a document ID that was extracted by the scanner 28 before the emergency stop. If the determination is positive, the routine proceeds to step 160, and if negative, the routine proceeds to step 168.

For example, there may be a situation in which the stopper gate 26 is left open at the time of an emergency stop. In such a case, a document might be fed in as far as the shredder unit 42 without a document destruction permission being obtained from the document management apparatus 14, and improper destruction processing would be possible. In the present exemplary embodiment, because the determination of the above-described step 158 is performed, only documents for which document destruction permission has been provided from the document management apparatus 14 are destroyed.

In step 160, the fifth feed roller driving section 74 is controlled and the fifth feed roller 48 is turned, and the document is conveyed in the direction of the fourth feed roller 44.

In step 162, the shredder unit driving section 70 is controlled and drives the shredder unit 42, and the document being fed in by the fifth feed roller 48 is taken in, shredded and destroyed.

In step 164, it is determined whether or not the document is absent from the scanning position of the path scanner 46 and the path scanner 46 has switched from the on state to the off state. If the determination is positive, the routine proceeds to step 166, and if negative, the routine returns to step 164.

In step 166, the shredder unit driving section 70 is controlled and, after a predetermined duration (for example, after the duration required until the trailing end portion of the document is taken into the shredder unit 42 and the whole document is shredded), driving of the shredder unit 42 stops, and a destruction completion notification, identifying the document ID of the document and indicating that destruction of the document has been completed, is sent to the document management apparatus 14 as a message.

Alternatively, if the determination of step 156 or of step 158 was negative, in step 168, destruction prohibition guidance, which has been prepared in advance, is displayed at the user interface 54.

In step 170, the second branching gate switching section 68 is controlled and the second branching gate 40 is switched. In step 172, the fifth feed roller driving section 74 is controlled, the fifth feed roller 48 is turned and the document is conveyed in the direction of the second branching gate 40. In step 174, the fourth feed roller driving section 72 is controlled, the fourth feed roller 44 is turned and the document is conveyed in the direction of arrow A2. Thus, the document is ejected (step 176) to an ejection tray (not shown).

Thus, with the present exemplary embodiment, the conveyance direction of a document may be altered such that the conveyance direction trailing end side of the document will be at the leading end side, such that a document ID that has been applied to the document will be destroyed last. Therefore, even in a case in which destruction processing by a shredder unit is emergency-stopped before destruction is completed, processing management of the document can be implemented until completion of the destruction of the document.

Moreover, with the present exemplary embodiment, when destruction processing by a shredding section has been emergency-stopped before destruction is completed, it is determined whether or not a document ID that is read before a restart matches a document ID that was read before the emergency stop, and destruction processing of the document is restarted only if they match. Therefore, only documents for which document destruction permission has been given are destroyed, and improper destruction processing can be prevented.

Second Exemplary Embodiment

Next, a document destruction apparatus relating to a second exemplary embodiment of the present invention will be described.

For the first exemplary embodiment, a case has been described in which a document is reversed using a first branching gate and a second branching gate. For the second exemplary embodiment however, a case will be described in which a reversal mechanism for reversing a document is provided on the conveyance path. Herebelow, portions that correspond with the first exemplary embodiment will not be described, and descriptions will mainly be given for differences from the first exemplary embodiment.

Figure 8:
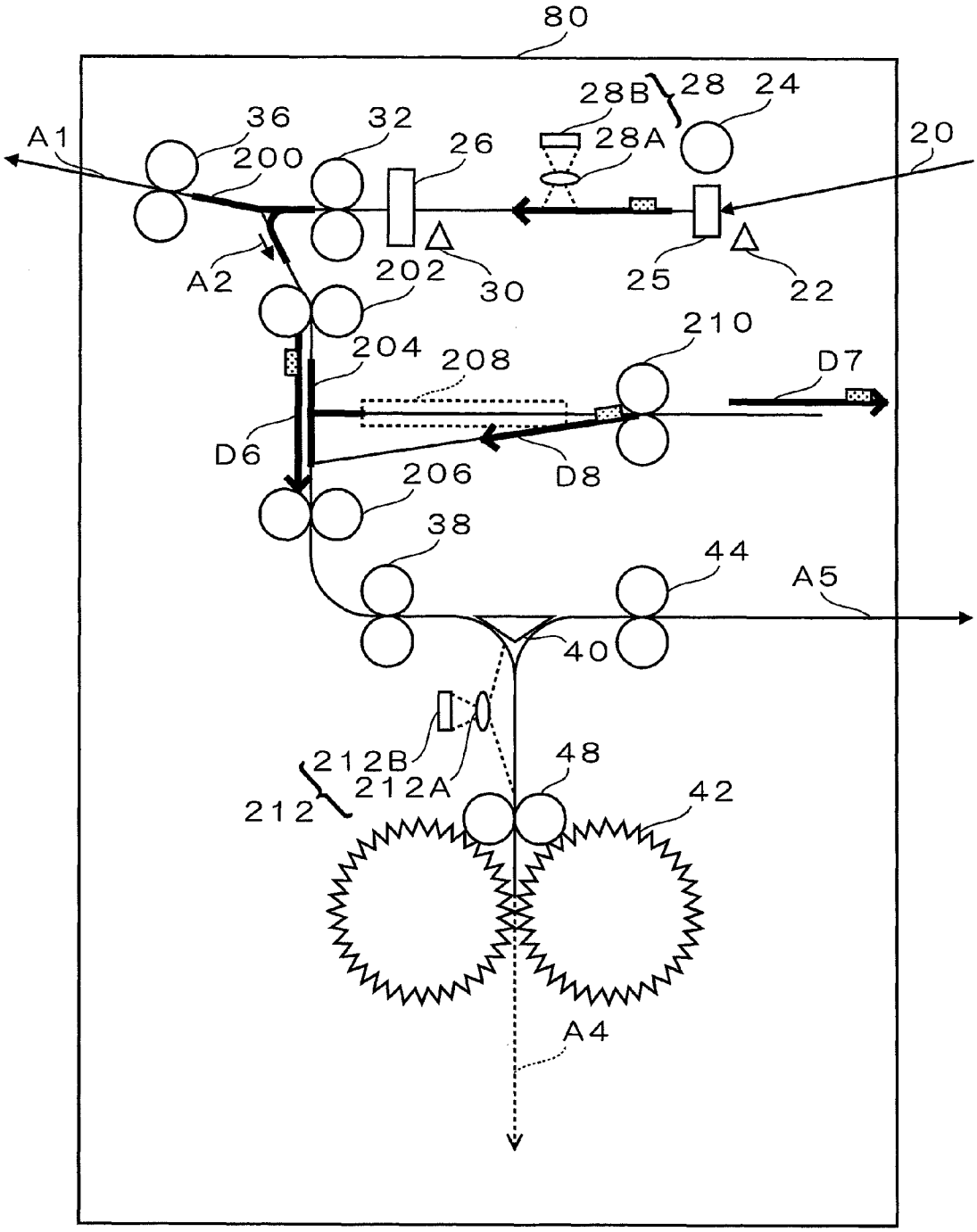
FIG. 8 is a structural view of principal elements of a document destruction apparatus relating to a second exemplary embodiment.

As shown in FIG. 8, a document destruction apparatus 80 relating to the second exemplary embodiment is provided with a first branching gate 200 at a branching position of the document conveyance path which splits into a bifurcated state at the document conveyance direction leading end side of the first feed roller 32. The first branching gate 200 switches the document conveyance path so as to guide a document being conveyed by turning of the first feed roller 32 in the direction of the second feed roller 36 or in the direction of a sixth feed roller 202.

The sixth feed roller 202 turns while nipping, at a nipping portion, the document which has been conveyed thereto by the first feed roller 32, and thus conveys the document so as to go in the direction of a reversal gate 204.

The reversal gate 204 switches the document conveyance path, at a branching position of the document conveyance path which splits into a bifurcated state at the document conveyance direction leading end side of the sixth feed roller 202, so as to guide the document being conveyed by turning of the sixth feed roller 202 in the direction of a seventh feed roller 206 or in the direction of a document inversion unit 208.

The seventh feed roller 206 turns while nipping, at a nipping portion, the document which has been conveyed thereto by the sixth feed roller 202, and thus conveys the document so as to go in the direction of the third feed roller 38.

Figure 9:
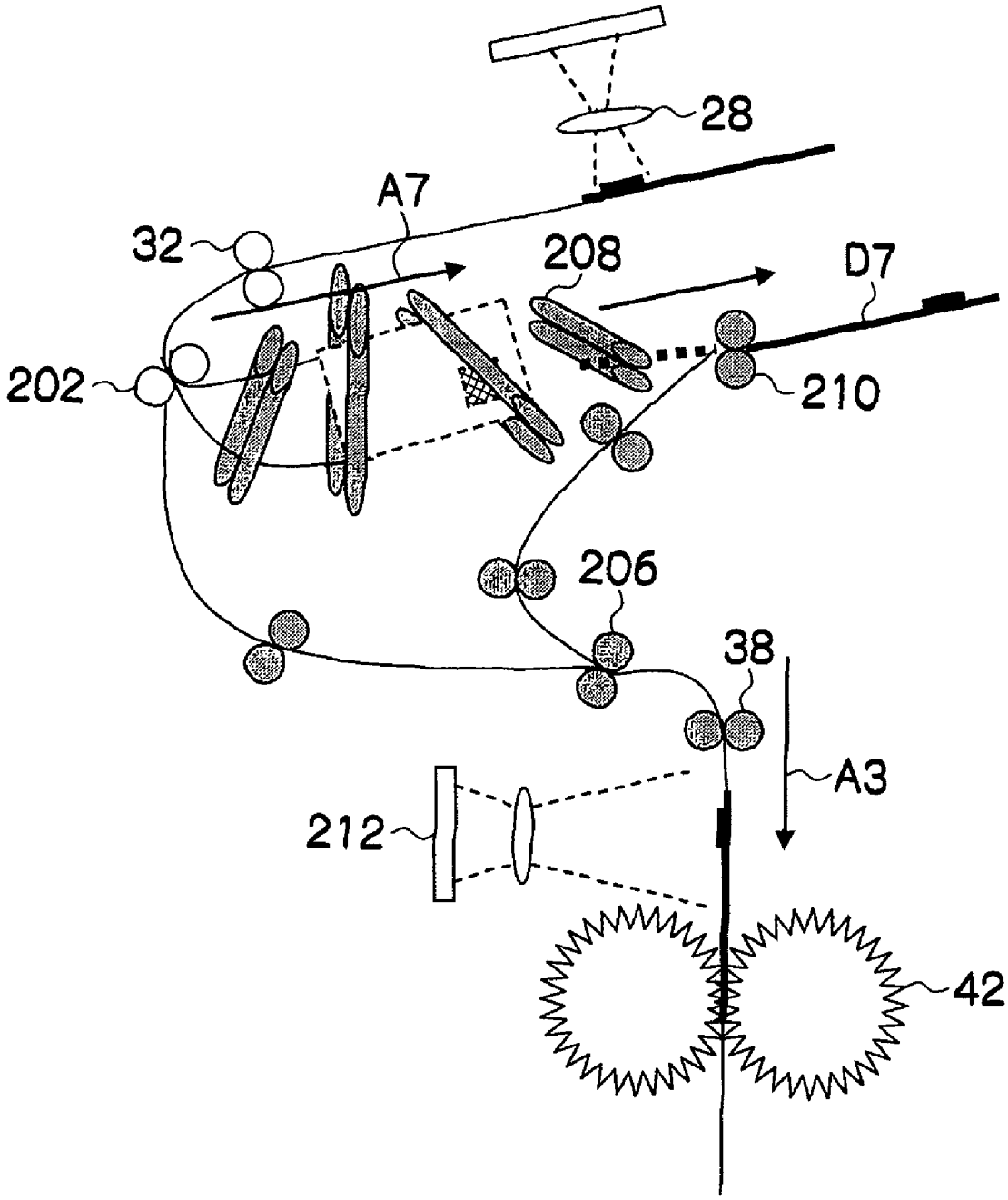
FIG. 9 is a diagram showing schematics of document conveyance in the document destruction apparatus relating to the second exemplary embodiment.

As shown in FIG. 9, the document inversion unit 208 nips the document at a nipping portion and turns the document while moving the document in the direction of arrow A7, and thus inverts a facing of the document between front and back.

A switchback roller 210 turns while nipping the document that has been conveyed thereto from the document inversion unit 208 at a nipping portion. Thus, the switchback roller 210 conveys the document along the document conveyance path in the direction of arrow D7. Further, when the turning direction is reversed, the conveyance direction of the document is altered such that the conveyance direction trailing end side of the document becomes the leading end side, and the document is conveyed along the document conveyance path in the direction of arrow D8.

A path scanner 212 scans a document just before the document conveyance path from the third feed roller 38 to the shredder unit 42 reaches the shredder unit 42. Via a lens 212B, the path scanner 212 detects light reflected from a light source (not shown) with an area sensor 212A, and thus scans the document. When a document is present at a scanning position of the path scanner 212, the path scanner 212 turns on, and when no document is present, the path scanner 212 turns off. Accordingly, when a leading end portion of a document passes through the scanning position of the path scanner 212, the path scanner 212 simultaneously switches from the off state to the on state, and thereafter, when a trailing end portion of the document passes through the scanning position of the path scanner 212, the path scanner 212 simultaneously switches from the on state to the off state. At the time of an emergency stop, the path scanner 212 scans the whole surface of a document and reads a QR code from the document.

Figure 10:
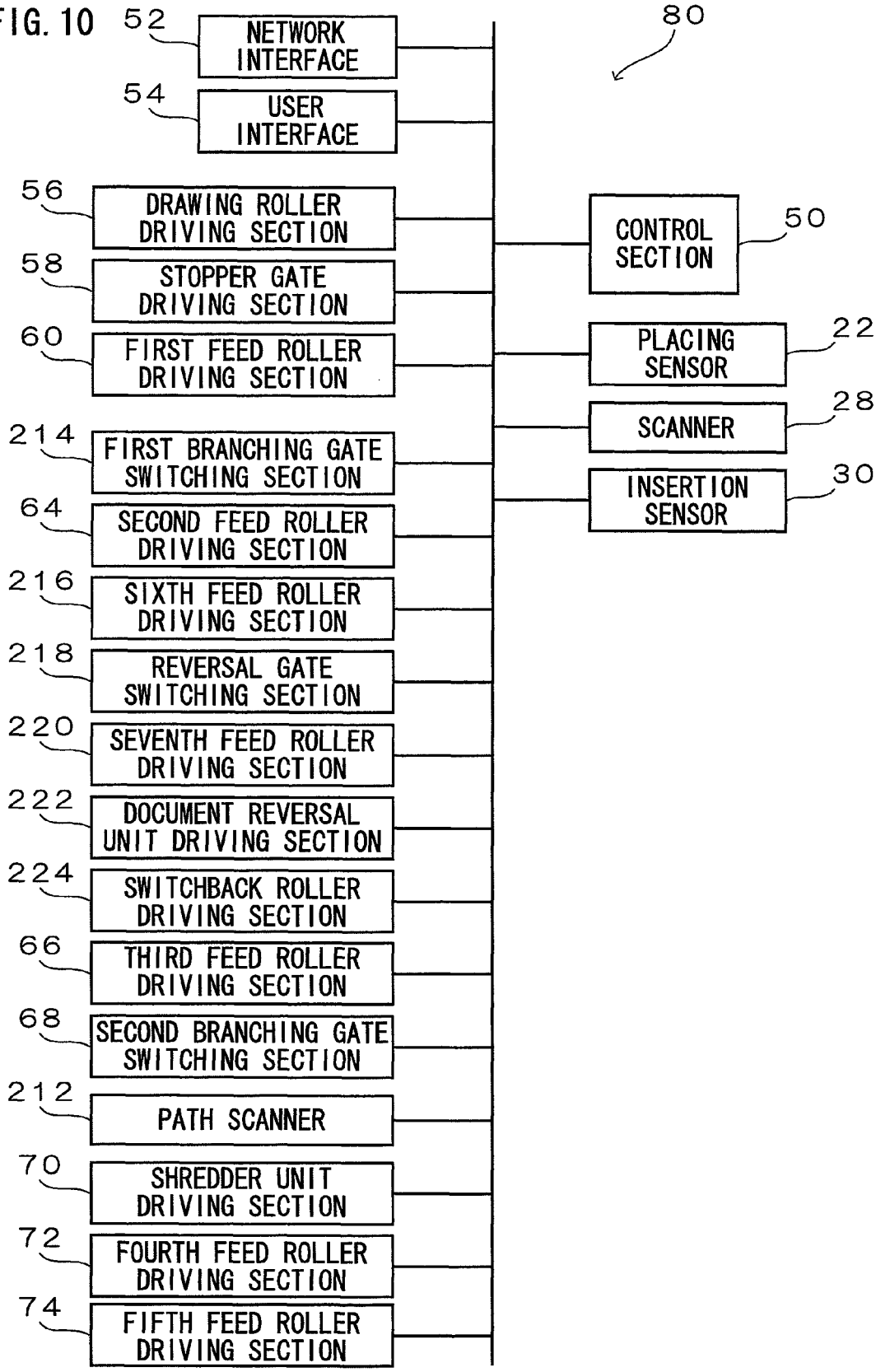
FIG. 10 is a structural diagram of a control system of the document destruction apparatus relating to the second exemplary embodiment.

As shown in FIG. 10, the document destruction apparatus 80 relating to the second exemplary embodiment is also structured to include: a first branching gate switching section 214, which is structured with, for example, a magnetic plunger as a drive source and which switches the aforementioned first branching gate 200; a sixth feed roller driving section 216, which is structured with, for example, a motor as a drive source and which causes turning operations of the aforementioned sixth feed roller 202; a reversal gate switching section 218, which is structured with, for example, a magnetic plunger as a drive source and which switches the aforementioned reversal gate 204; a seventh feed roller driving section 220, which is structured with, for example, a motor as a drive source and which causes turning operations of the aforementioned seventh feed roller 206; a document inversion unit driving section 222, which drives the aforementioned document inversion unit 208; and a switchback roller driving section 224, which is structured with, for example, a motor as a drive source and which causes turning operations of the aforementioned switchback roller 210.

The first branching gate switching section 214, the sixth feed roller driving section 216, the reversal gate switching section 218, the seventh feed roller driving section 220, the document inversion unit driving section 222 and the switchback roller driving section 224 are respectively electrically connected to the control section 50, and are controlled by the control section 50.

Figure 11A:
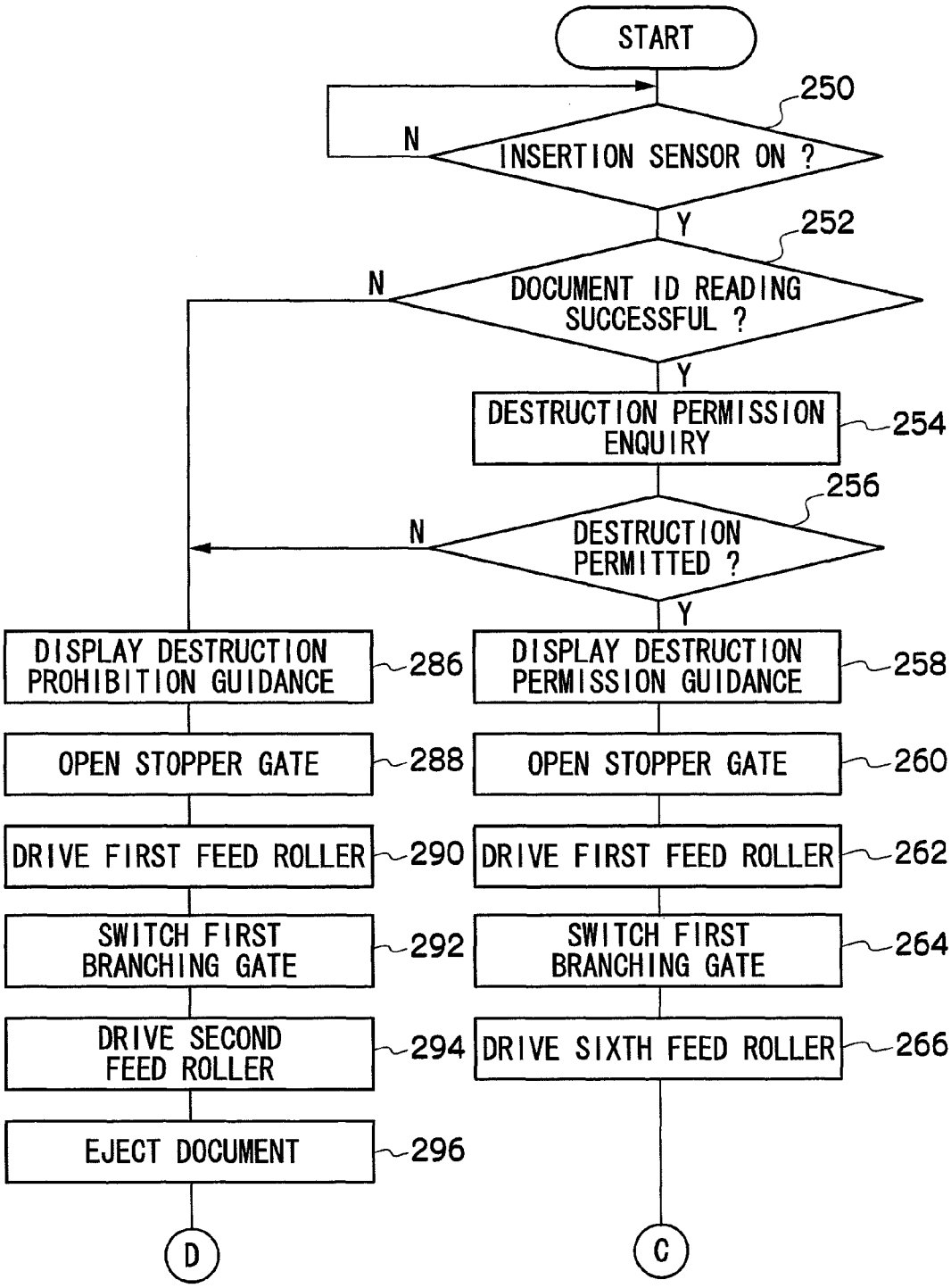
FIG. 11A is a flowchart showing a destruction processing routine when an emergency stop does not occur, relating to the second exemplary embodiment.
Figure 11B:
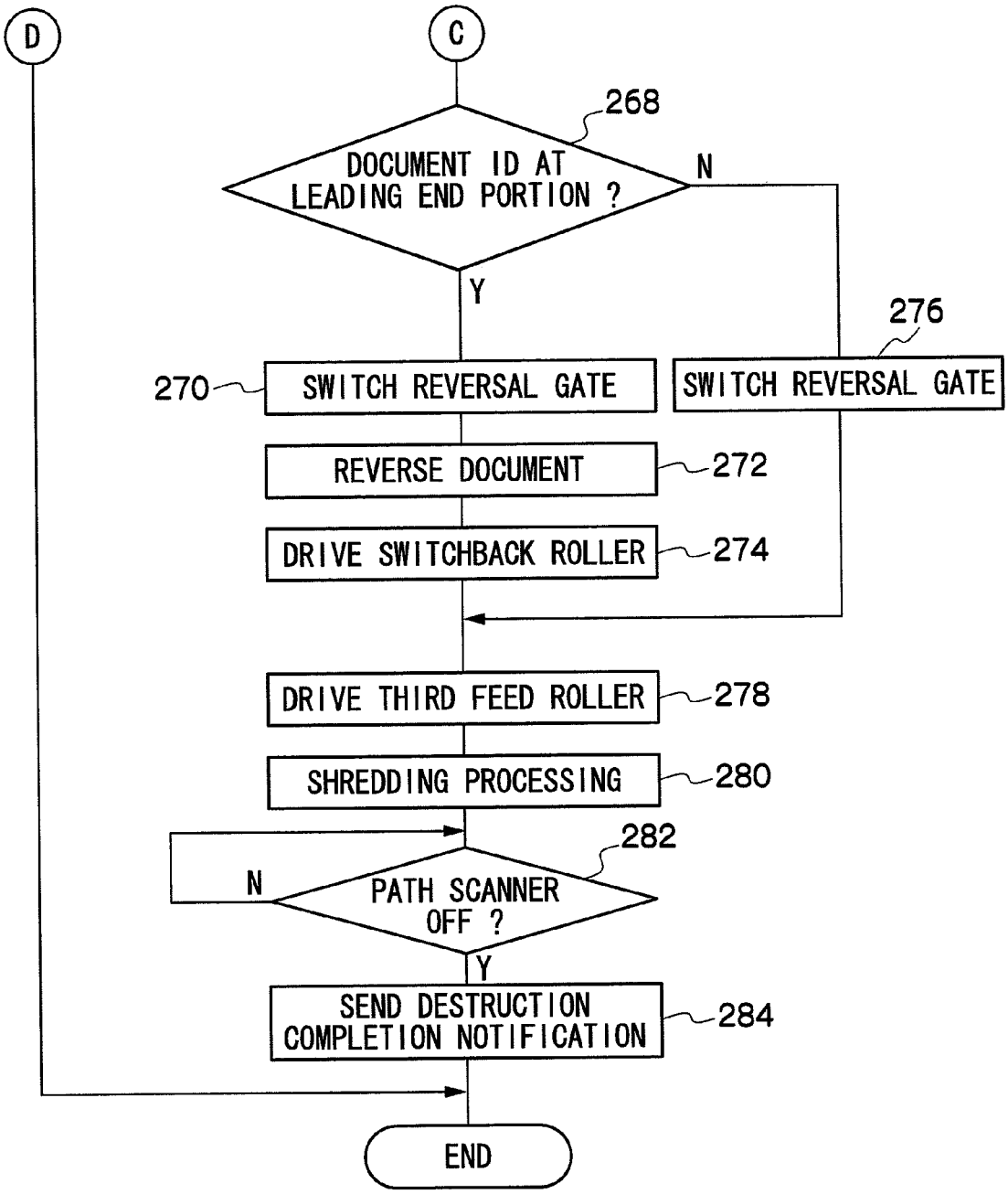
FIG. 11B is a flowchart showing a destruction processing routine when an emergency stop does not occur, relating to the second exemplary embodiment.

Next, with reference to FIGS. 11A and 11B, description will be given of a destruction processing routine according to the control section 50 for a case in which an emergency stop does not occur.

In step 250, it is determined whether or not the insertion sensor 30 is in the on state. If the determination is positive, the routine proceeds to step 252, and if negative, the routine returns to step 250.

In step 252, it is determined whether or not the scanner 28 has succeeded in reading of a QR code that has been applied to a document. If the determination is positive, the routine proceeds to step 254, and if negative, the routine proceeds to step 286.

In step 254, an enquiry to the document management apparatus 14, as to whether or not destruction is permitted for the document specified by the document ID included in the QR code, is implemented.

In step 256, it is determined whether a response message indicating that a document destruction permission is being given has been received from the document management apparatus 14 or a response message indicating that a document destruction permission is not being given has been received. If a response message indicating that a document destruction permission is being given has been received, the routine proceeds to step 258, and if a response message indicating that a document destruction permission is not being given has been received, the routine proceeds to step 286.

In step 258, destruction permission guidance, which has been prepared in advance, is displayed at the user interface 54.

In step 260, the stopper gate driving section 58 is controlled and the stopper gate 26 opens.

In step 262, the first feed roller driving section 60 is controlled and the first feed roller 32 is turned. In step 264, the first branching gate switching section 214 is controlled and the first branching gate 34 is switched such that the document is conveyed in the direction of arrow A2. In step 266, the sixth feed roller driving section 216 is controlled and the sixth feed roller 202 is turned.

In step 268, it is determined whether or not the QR code that has been read by the scanner 28 had been applied at the conveyance direction leading end side of the document. If the determination is positive, the routine proceeds to step 270, and if negative, the routine proceeds to step 276.

In step 270, the reversal gate switching section 218 is controlled and the reversal gate 204 is switched such that the document is conveyed in the direction of the document inversion unit 208.

In step 272, the document inversion unit driving section 222 is controlled and the document inversion unit 208 is driven and inverts the facing of the document between front and back.

In step 274, the switchback roller driving section 224 is controlled and the switchback roller 210 is turned. Thus, the document is conveyed in the direction of arrow D7. In addition, by control of the switchback roller driving section 224 and reversal of the turning direction of the switchback roller 210, the conveyance direction of the document is altered such that the conveyance direction trailing end side of the document becomes the leading end side and, as shown by arrow D8, the document is conveyed in the direction of the seventh feed roller 206.

In step 276, the reversal gate switching section 218 is controlled and the reversal gate 204 is switched such that the document is conveyed in the direction of the seventh feed roller 206.

In step 278, the third feed roller driving section 66 is controlled and the third feed roller 38 is turned, and conveys the document in the direction of the shredder unit 42.

In step 280, the fifth feed roller driving section 74 is controlled and the fifth feed roller 48 is turned and conveys the document to the shredder unit 42, in addition to which the shredder unit driving section 70 is controlled and drives the shredder unit 42, and the document that has been fed in by the fifth feed roller 48 is taken in, shredded and destroyed.

In step 282, it is determined whether or not the document is absent from the scanning position of the path scanner 46 and the path scanner 46 has switched from the on state to the off state. If the determination is positive, the routine proceeds to step 284, and if negative, the routine returns to step 282.

In step 284, the shredder unit driving section 70 is controlled and, after a predetermined duration (for example, after the duration required until the trailing end portion of the document is taken into the shredder unit 42 and the whole document is shredded), driving of the shredder unit 42 stops, and a destruction completion notification, identifying the document ID of the document and indicating that destruction of the document has been completed, is sent to the document management apparatus 14 as a message.

Accordingly, the document management apparatus 14 registers the date/time at which the message was received in a document destruction date/time field, which serves as destruction history information corresponding to the document ID identified in the message.

Alternatively, if the determination of step 252 or of step 256 was negative, in step 286, destruction prohibition guidance, which has been prepared in advance, is displayed at the user interface 54.

In step 288, the stopper gate driving section 58 is controlled and the stopper gate 26 is opened, in step 290, the first feed roller driving section 60 is controlled and the first feed roller 32 is turned, in step 292, the first branching gate switching section 214 is controlled and switches the first branching gate 34 such that the document is conveyed in the direction of the second feed roller 36, and in step 294, the second feed roller driving section 64 is controlled and causes the second feed roller 36 to turn. Thus, the document is conveyed in the direction of arrow A1, and is ejected (step 296) to an ejection tray (not shown).

Third Exemplary Embodiment

Next, a document destruction apparatus relating to a third exemplary embodiment of the present invention will be described.

For the third exemplary embodiment, a case will be described in which a reversal mechanism that is different from the reversal mechanism provided in the document destruction apparatus relating to the second exemplary embodiment is provided on the conveyance path. Herebelow, portions that correspond with the second exemplary embodiment will not be described, and descriptions will mainly be given for differences from the second exemplary embodiment.

Figure 12:
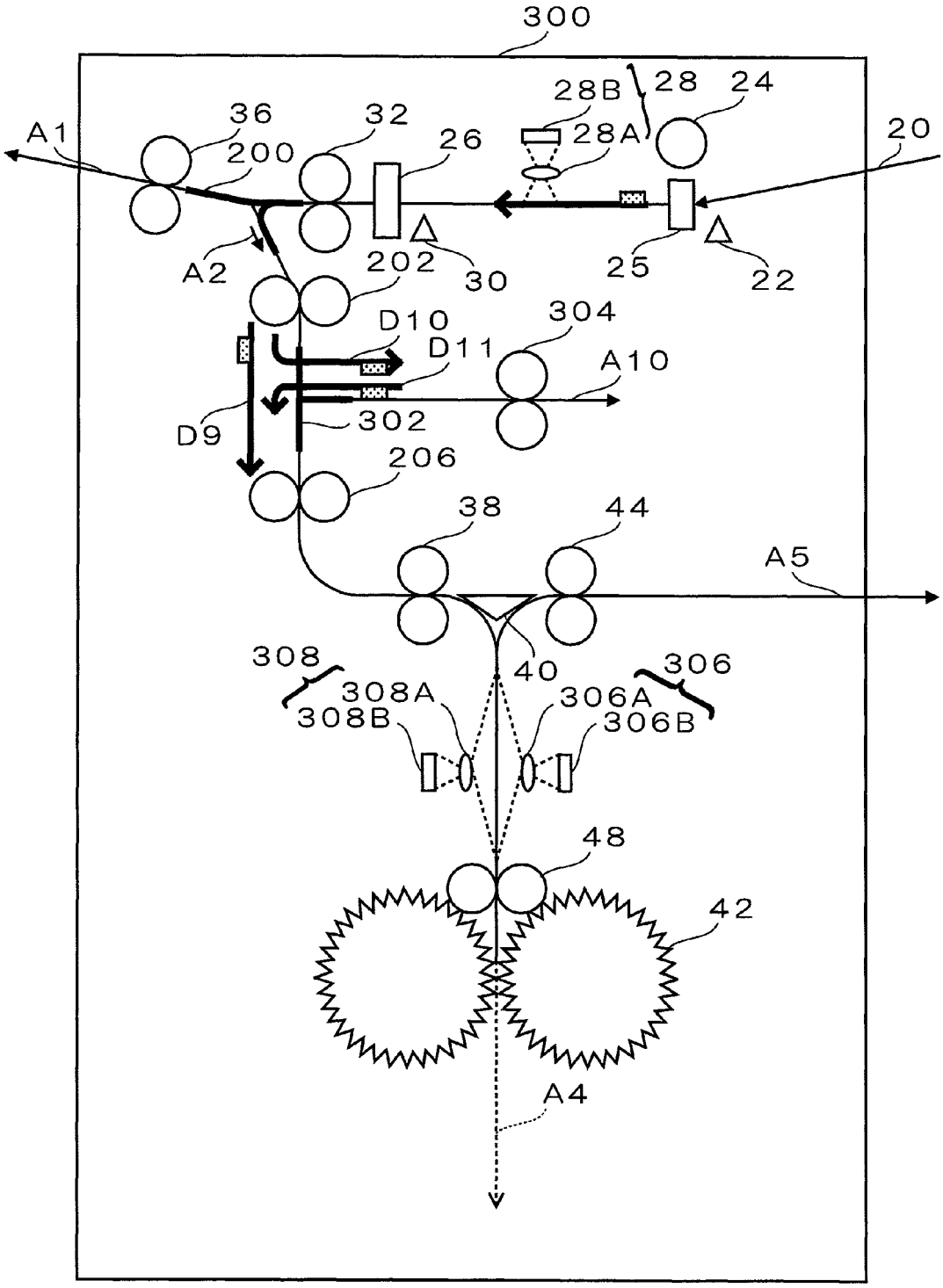
FIG. 12 is a structural view of principal elements of a document destruction apparatus relating to a third exemplary embodiment.

As shown in FIG. 12, the sixth feed roller 202 is provided in a document destruction apparatus 300 relating to the third exemplary embodiment. The sixth feed roller 202 turns while nipping, at the nipping portion, a document which has been conveyed thereto by the first feed roller 32, and thus conveys the document so as to go in the direction of a reversal gate 302.

At a branching position of the document conveyance path which splits into a bifurcated state at the document conveyance direction leading end side of the sixth feed roller 202, the reversal gate 302 switches the document conveyance path so as to guide a document being conveyed by turning of the sixth feed roller 202 in the direction of the seventh feed roller 206, shown by arrow D9, or in the direction of a switchback roller 304, shown by arrow D10.

The switchback roller 304 turns while nipping, at a nipping portion, the document that has been conveyed thereto from the reversal gate 302 as shown by arrow D10. Thus, the switchback roller 304 conveys the document along the document conveyance path in the direction of arrow A10. Further, when the turning direction of the switchback roller 304 is reversed, the conveyance direction of the document is altered such that the conveyance direction trailing end side of the document becomes the leading end side, and the document is conveyed along the document conveyance path as shown by arrow D1. The facing of the document whose conveyance direction is altered by the switchback roller 304 is inverted between front and back.

The document destruction apparatus 300 relating to the third exemplary embodiment is equipped with a path scanner 306 for scanning the front face side of a document whose facing has been inverted between front and back by the switchback roller 304, and a path scanner 308 for scanning the front face side of a document whose facing has not been inverted between front and back.

The path scanners 306 and 308 scan documents just before the document conveyance path from the third feed roller 38 to the shredder unit 42 reaches the shredder unit 42. When a document is present at a scanning position of either of the path scanners 306 and 308, the path scanner 306 or 308 is in an on state, and when no document is present, the path scanner 306 or 308 is in an off state. Accordingly, when a leading end portion of a document passes through the scanning position of either of the path scanners 306 and 308, the path scanner 306 or 308 simultaneously switches from the off state to the on state, and thereafter, when a trailing end portion of the document passes through the scanning position of the path scanner 306 or 308, the path scanner 306 or 308 simultaneously switches from the on state to the offstate. When destruction processing by the shredder unit 42 has been emergency-stopped, both of the path scanners 306 and 308 scan the whole surface of a document and read a QR code from the document.

Fourth Exemplary Embodiment

Next, a document destruction apparatus relating to a fourth exemplary embodiment of the present invention will be described.

The document destruction apparatus relating to the fourth exemplary embodiment is further provided with a removal opening for removing a document to outside the document destruction apparatus when destruction has been emergency-stopped. Herebelow, portions that correspond with the first exemplary embodiment will not be described, and descriptions will mainly be given for differences from the first exemplary embodiment.

Figure 13:
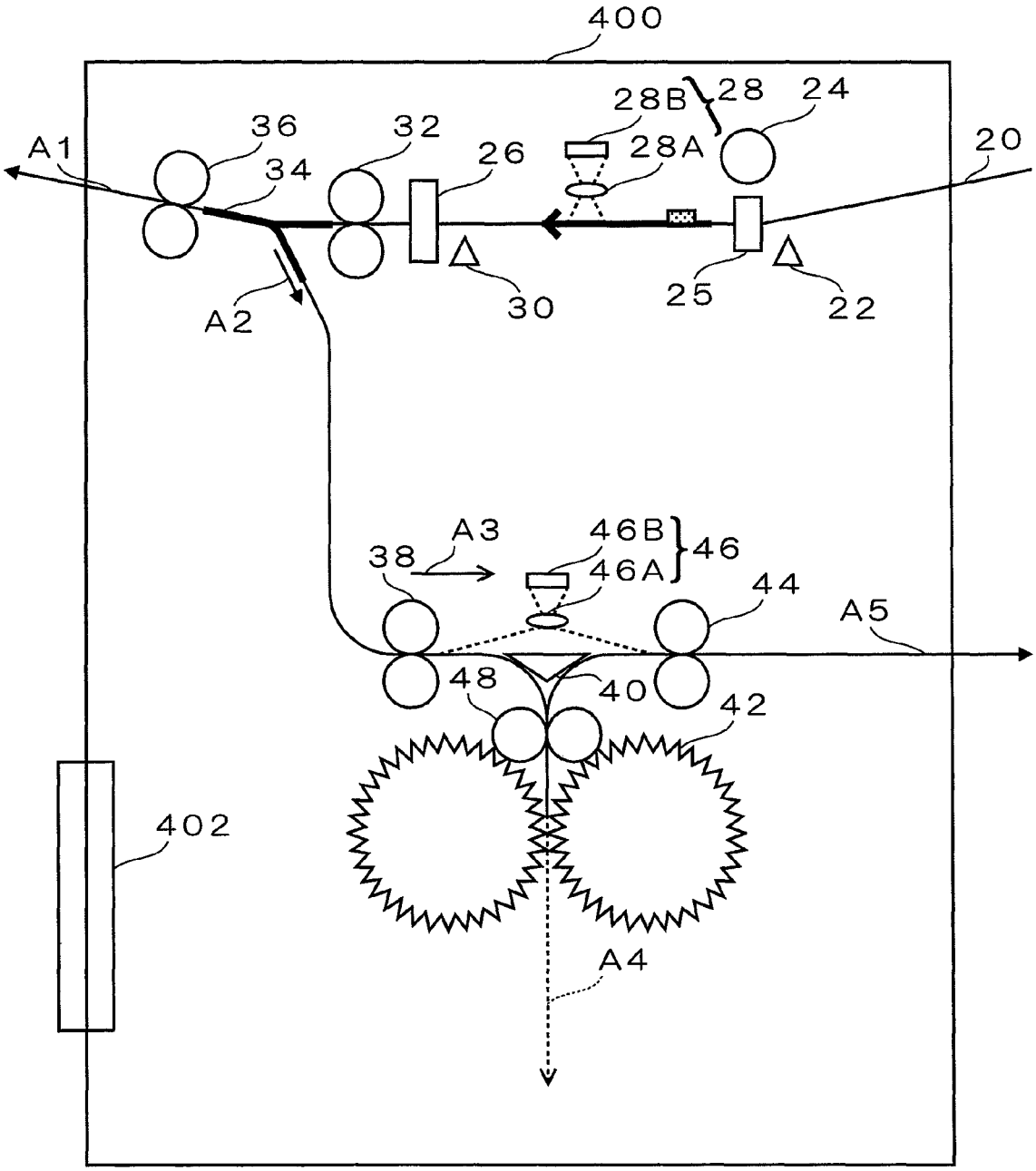
FIG. 13 is a structural view of principal elements of a document destruction apparatus relating to a fourth exemplary embodiment.

As shown in FIG. 13, a document destruction apparatus 400 relating to the fourth exemplary embodiment is provided with a window portion 402 in a vicinity of the shredder unit 42. The window portion 402 is provided with an openable/closeable door and is for removing a document to outside the document destruction apparatus 400 when destruction processing by the shredder unit 42 has been emergency-stopped.

Figure 14:
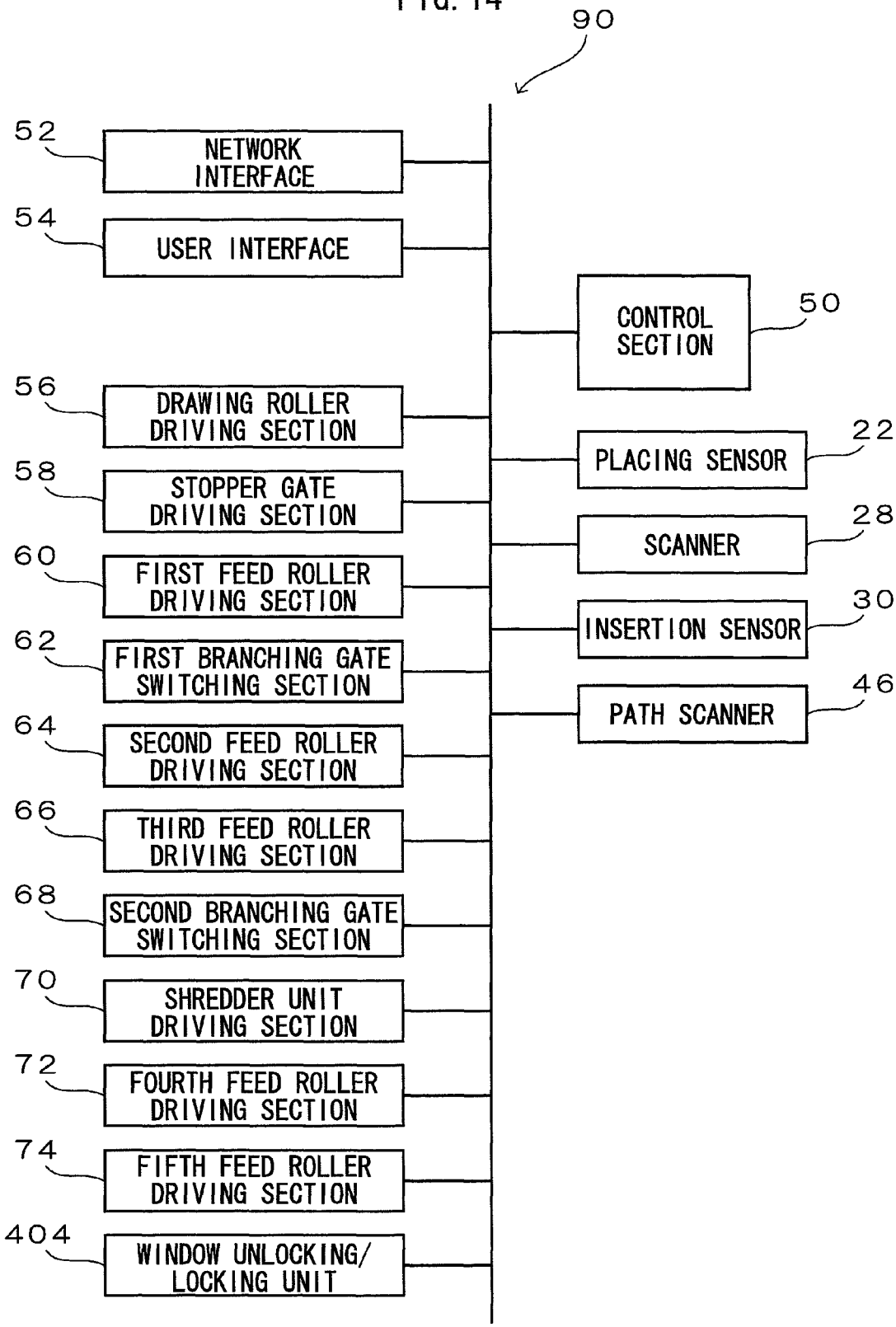
FIG. 14 is a structural diagram of a control system of the document destruction apparatus relating to the fourth exemplary embodiment.

As shown in FIG. 14, the document destruction apparatus 400 is also provided with a window unlocking/locking unit 404, which locks the door in order to prevent opening of the window portion 402, and unlocks the door in order to release the prohibition on opening. The window unlocking/locking unit 404 is electrically connected to the control section 50 and is controlled by the control section 50.

Figure 15:
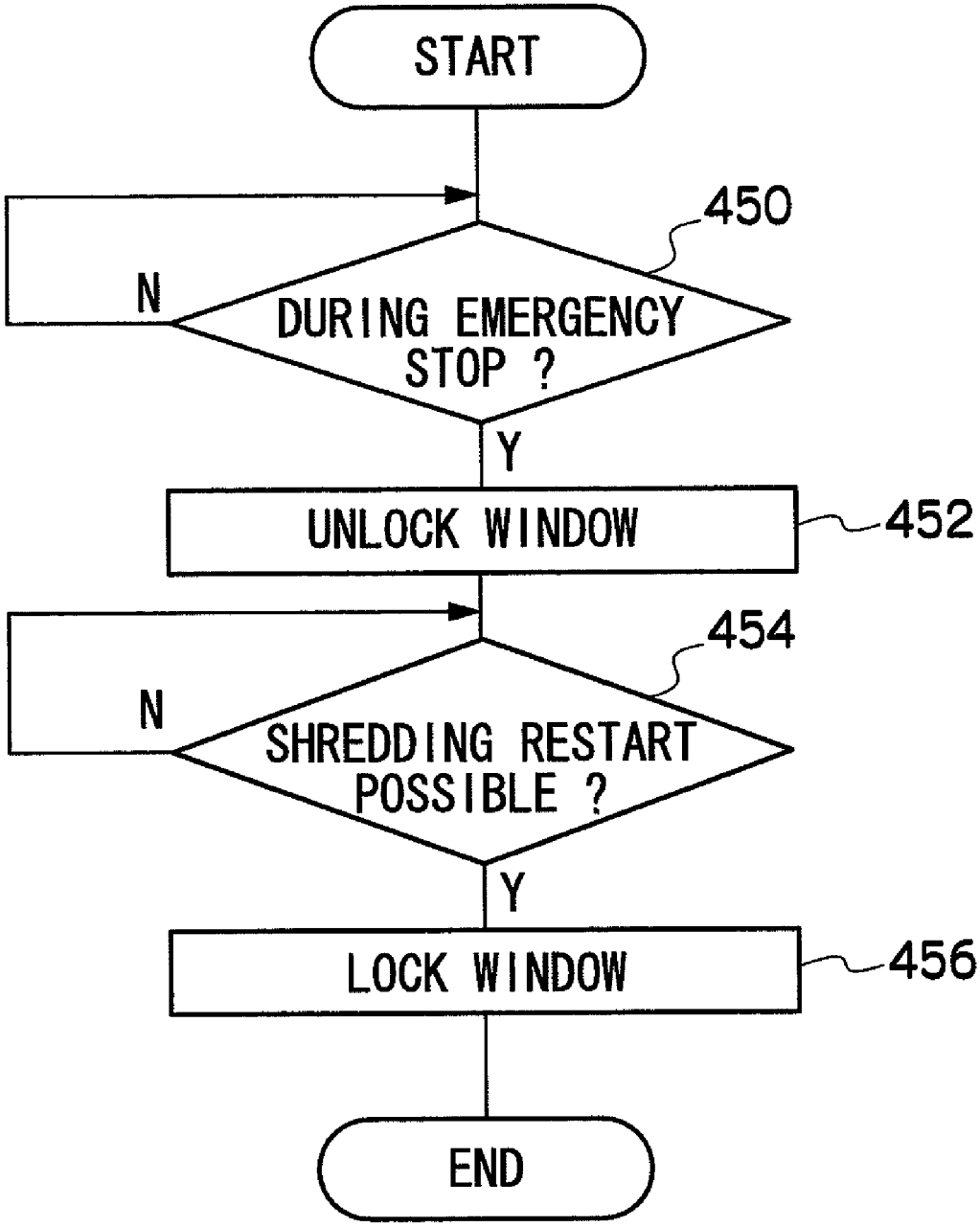
FIG. 15 is a flowchart showing a destruction processing routine when an emergency stop has occurred, relating to the fourth exemplary embodiment.

Next, with reference to FIG. 15, description will be given of a processing routine according to the control section 50 for a case in which an emergency stop has occurred.

In step 450, it is determined whether or not destruction processing by the shredder unit 42 has been emergency-stopped. If the determination is positive, the routine proceeds to step 452, and if negative, the routine returns to step 450.

In step 452, the window unlocking/locking unit 404 is controlled and the door of the window portion 402 is unlocked.

In step 454, it is determined whether or not a restart of destruction processing by the shredder unit 42 is possible. If the determination is positive, the routine proceeds to step 456, and if negative, the routine returns to step 454.

In step 456, the window unlocking/locking unit 404 is controlled and the door of the window portion 402 is locked.

Figure 16:
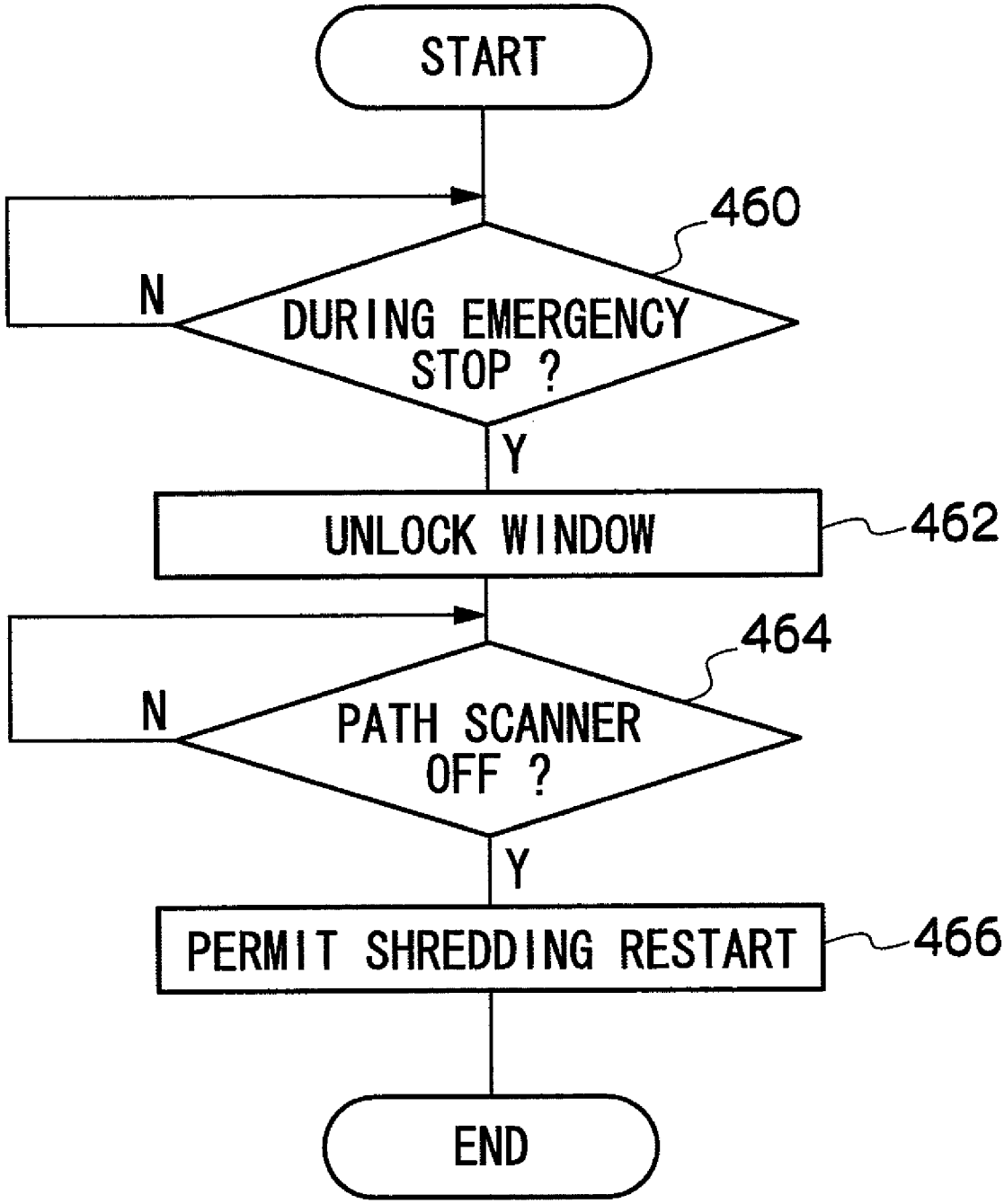
FIG. 16 is a flowchart showing a destruction processing routine when an emergency stop has occurred, relating to the fourth exemplary embodiment.

Further, when destruction processing by the shredder unit 42 has been emergency stopped, control may be performed so as not to restart destruction processing until a document has been cleared from the shredder unit 42, that is, until the path scanner 46 is in the off state. A processing routine according to the control section 50 for such a case will be described with reference to FIG. 16.

In step 460, it is determined whether or not destruction processing by the shredder unit 42 has been emergency-stopped. If the determination is positive, the routine proceeds to step 462, and if negative, the routine returns to step 460.

In step 462, the window unlocking/locking unit 404 is controlled and the door of the window portion 402 is unlocked.

In step 464, it is determined whether or not the path scanner 46 is in the off state. If the determination is positive, the routine proceeds to step 466, and if negative, the routine returns to step 464.

In step 466, a restart of destruction processing by the shredder unit 42 is permitted.

Figure 17:
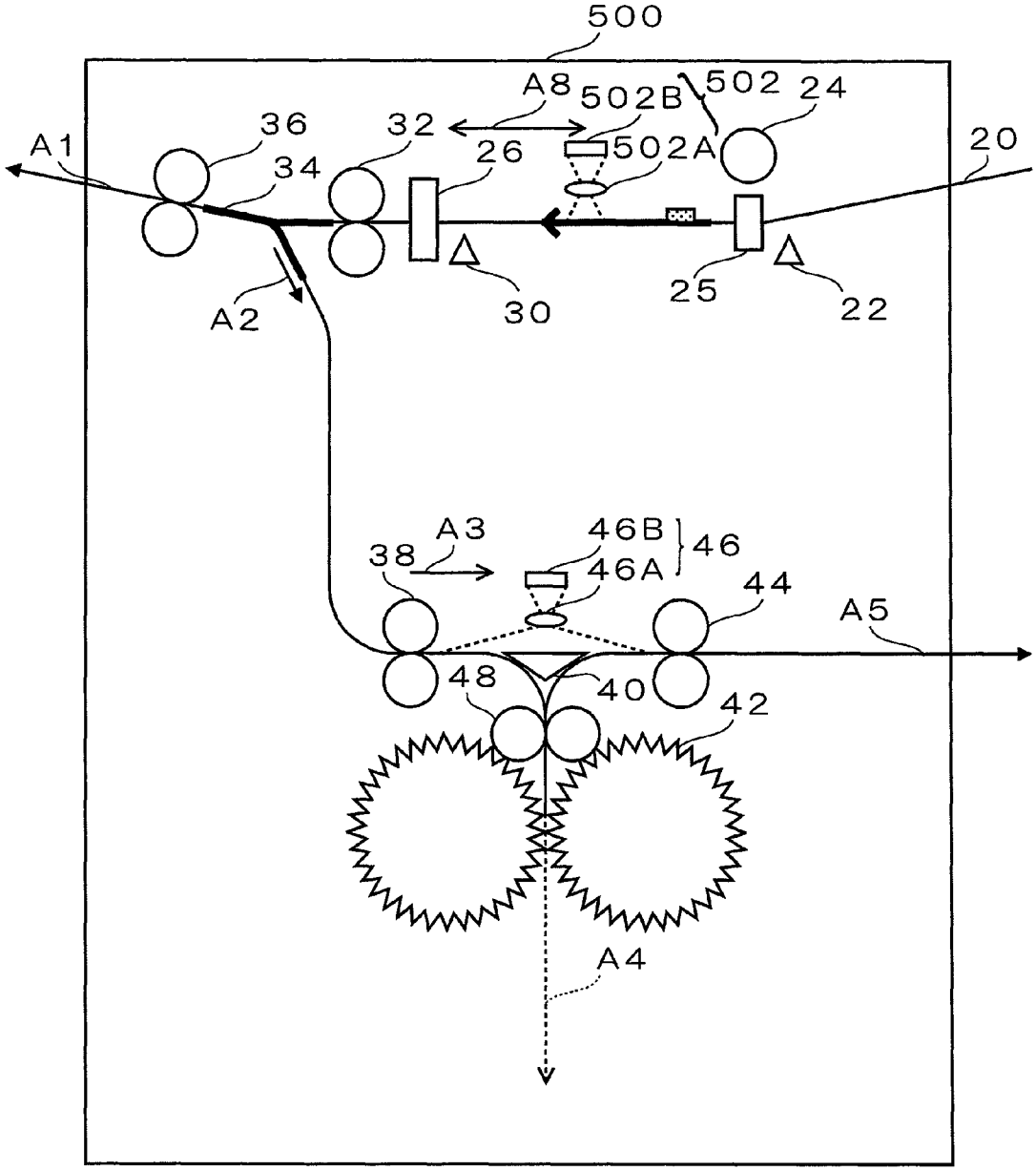
FIG. 17 is a structural view of principal elements of a variant example of a document destruction apparatus relating to the present exemplary embodiments.

Hereabove, descriptions have been given for cases in which scanners are fixed. However, as shown in FIG. 17, a document destruction apparatus 500 may be provided with a scanner 502 that is provided to be movable with respect to a document, and reads a document ID in a state in which the scanner 502 is moving relative to the document. In such a case, it is sufficient for the scanner 502 to start to move when the insertion sensor 30 detects the document and read the whole surface of the document.

Via a lens 502B, the scanner 502 detects light emitted from a light source (not shown) with a line sensor 502A, at which pixels are arranged in a direction intersecting the document conveyance direction (a direction between front and back of the paper of FIG. 17). Thus, the scanner 502 reads the whole surface of a document that has been stopped by the stopper gate 26, and scans a QR code which has been applied to the document.

Further, a scanner may be provided fixed at a trailing end side of the document conveyance direction, and documents may be inserted by operators such that the QR codes of the documents are at the trailing end side in the document conveyance direction. In such a case, a mechanism for reversing is not necessary. When a document is placed such that the QR code is disposed at the leading end side in the document conveyance direction, the document is ejected to the ejection tray.

Further yet, a scanner may be provided fixed at a leading end side of the document conveyance direction, and documents may be inserted by operators such that the QR codes of the documents are at the leading end side in the document conveyance direction. In such a case, the conveyance directions of all documents for which destruction is permitted are altered such that the conveyance direction trailing end sides of the documents become the leading end sides. When a document is placed such that the QR code is disposed at the trailing end side in the document conveyance direction, the document is ejected to the ejection tray.

What is claimed is:

1. A document destruction apparatus comprising:

a destruction section that destroys documents;

a conveyance section that conveys documents to the destruction section a page at a time;

a reading section that is disposed partway along the conveyance section and that, from a document to which identification information for identifying the document has been applied to each page at least one of a conveyance direction leading end side and trailing end side, reads the identification information at each page; and an alteration section that, in a case in which the identification information has been read at the conveyance direction leading end side by the reading section, alters a conveyance direction of the page that has been read such that the page being conveyed from the conveyance direction leading edge side of the page will be conveyed from the conveyance direction trailing end side of the page.

2. The document destruction apparatus of claim 1, wherein the reading section is provided in a state of being stationary with respect to the conveyance section, and reads the identification information in a state in which the document is being conveyed a page at a time.

3. The document destruction apparatus of claim 1, wherein the reading section is provided to be movable with respect to the conveyance section, and moves while reading the identification information in a state in which the reading section and a page of the document are relatively moving.

4. The document destruction apparatus of claim 1, further comprising:

a pre-destruction reading section that, when a restart of destruction has become possible after an emergency stop of destruction by the destruction section, reads identification information applied to a page that is present in a vicinity of the destruction section; and a restart section that restarts destruction by the destruction section if identification information that was read by the reading section before the emergency stop and the identification information read by the pre-destruction reading section match.

5. The document destruction apparatus of claim 4, further comprising an ejection section that, if the identification information that was read by the reading section before the emergency stop and the identification information read by the pre-destruction reading section do not match ejects the page of the document to outside the document destruction apparatus.

6. The document destruction apparatus of claim 1, further comprising a removal port for removing a page of the document to outside the document destruction apparatus when there has been an emergency stop of destruction by the destruction section.

7. The document destruction apparatus of claim 4, further comprising a removal port for removing a page of the document to outside the document destruction apparatus when there has been an emergency stop of destruction by the destruction section.

8. The document destruction apparatus of claim 5, further comprising a removal port for removing a page of the document to outside the document destruction apparatus when there has been an emergency stop of destruction by the destruction section.

* * * * *